United States Patent [19]

Pardo

[11] Patent Number: 4,700,527

[45] Date of Patent: Oct. 20, 1987

[54] CONCRETE MASONRY BLOCK WALL CLADDING CONSTRUCTION SYSTEM AND BLOCKS FOR SAME

[75] Inventor: Jorge Pardo, Reston, Va.

[73] Assignee: National Concrete Masonry Association, Herndon, Va.

[21] Appl. No.: 771,499

[22] Filed: Aug. 29, 1985

Related U.S. Application Data

[63] Continuation-in-part of Ser. No. 570,684, Jan. 13, 1984, abandoned.

[51] Int. Cl.[4] ..... E04B 2/72

[52] U.S. Cl. ..... 52/763; 52/772; 52/779

[58] Field of Search ..... 52/763, 772, 779, 486–489, 52/279, 391, 461, 309.8, 309.9, 98, 100, 408, 464, 571, 437, 599, 235

[56] References Cited

U.S. PATENT DOCUMENTS

| | | | |
|---|---|---|---|
| 525,097 | 8/1894 | Flint | 52/779 |
| 802,903 | 10/1905 | Anderson | 52/279 |
| 876,399 | 1/1909 | Robinson | 52/408 |
| 1,323,514 | 12/1919 | Whitacre | 52/437 |
| 1,388,181 | 8/1921 | Guimonneau | 52/571 |
| 1,800,609 | 4/1931 | Drake | 52/461 |
| 1,857,490 | 5/1932 | Barrett | 52/774 |
| 1,991,550 | 2/1935 | Duffy | 52/486 |
| 1,997,092 | 4/1935 | Duffy | 52/488 |
| 2,101,612 | 12/1937 | Duffy | 52/599 |
| 2,294,556 | 9/1942 | Henderson | 52/235 |
| 2,438,140 | 3/1948 | Auten | 52/464 |
| 2,540,622 | 2/1951 | Langenberg | 52/279 |
| 3,005,293 | 10/1961 | Hunter | 52/510 |
| 3,175,656 | 3/1965 | Schoenfeld | 52/488 |
| 3,360,896 | 1/1968 | Wright | 52/779 |
| 3,559,358 | 2/1971 | Lohse et al. | 52/391 |
| 4,058,944 | 11/1977 | Rieger | 52/235 |
| 4,222,210 | 9/1980 | Hanstein et al. | 52/461 |

FOREIGN PATENT DOCUMENTS

| | | | |
|---|---|---|---|
| 1183231 | 1/1959 | France | 52/100 |
| 2315592 | 1/1977 | France | 52/509 |
| 493172 | 4/1954 | Italy | 52/563 |
| 614059 | 12/1948 | United Kingdom | 52/100 |
| 2604704 | 8/1977 | United Kingdom | 52/309.9 |

*Primary Examiner*—James L. Ridgill, Jr.

*Attorney, Agent, or Firm*—Lowe, Price, LeBlanc, Becker & Shur

[57] ABSTRACT

A concrete masonry ("CM") block wall cladding using specially configured CM veneer blocks is applied to a substrate wall such as the exterior wall of a building. Horizontally extending support means are mounted on the substrate wall(s) and a plurality of elongated battens are secured to the substrate wall at laterally spaced intervals and extending vertically above such horizontally extending support means; a plurality of CM veneer blocks are vertically supported by the horizontally extending support means with portions of the CM blocks being secured to adjacent laterally spaced battens, thereby mounting the CM veneer blocks on the substrate wall to form a CM veneer block wall cladding. A multi-story CM block veneer wall cladding construction for a multi-story building may be similarly constructed by using a plurality of horizontally extending support means mounted on the substrate wall at vertically spaced invervals so as to support a section of the CM block wall cladding of suitable height. The CM veneer blocks are configured and sized so that they can be made in a conventional CM casting machine with suitably modified molds. Various preferred configurations of such CM veneer blocks are provided so that the blocks may be cut by workmen in the field to one of a number of different lengths for installation on substrate wall sections which do not conform to established modular sizes. A variety of preferred configurations of inside and outside CM corner veneer blocks are also provided. A variety of battens are provided for mounting the CM veneer blocks on substrate walls. The CM veneer blocks and the wall cladding system are designed so that CM veneer block wall cladding can be constructed by unskilled workers rather than requiring skilled masons or other costly artisans. The CM veneer block wall cladding and CM blocks for same can be used to retrofit to existing walls as well as to apply them to new walls.

32 Claims, 35 Drawing Figures

80h
86k
87k
81k
89k
83k
94
99
89p
83p
146b
86m
87m
81m
89m
83m
89n
83n
80g
146a
96
80e
86c
87c
81h
89h
92
140b
86f
80d
134d
140d
138d
89g
83g
81g
87f
iv
iii
v

CONCRETE MASONRY BLOCK WALL CLADDING CONSTRUCTION SYSTEM AND BLOCKS FOR SAME

BACKGROUND OF THE INVENTION

This is a continuation-in-part of my copending application Ser. No. 570,684 filed Jan. 13, 1984, now abandoned, for "CONCRETE MASONRY BLOCK WALL CONSTRUCTION AND BLOCKS FOR SAME".

The present invention relates to certain types of concrete masonry construction for external walls to provide low cost improved construction and efficient manufacture and field installation and various functional and other advantages.

In a preferred embodiment of the invention, concrete masonry blocks ("CM blocks") of modified form (sometimes called "CM veneer blocks") are used to construct a concrete masonry block veneer wall cladding secured to the sides of the building exterior walls made of brick, concrete block, wood or other conventional wall constructions (sometimes called "wall substrate" and/or "substrate wall"). Thermal insulation materials may or may not be installed in or on substrate walls on which such CM veneer blocks are installed to form CM block veneer wall cladding. Additionally, the CM veneer blocks preferably are installed by means such as battens so as to provide an air space between the CM block veneer wall and the base building wall to increase insulation with resultant energy savings, and also to provide air space for venting and moisture shedding between the wall substrate and the CM veneer block wall. A decorative surface can be applied to the CM veneer blocks so as to provide a decorative wall cladding surface, if desired, especially when the building walls are made of a plain inexpensive material such as concrete block. For such CM block veneer wall cladding construction, there are provided various novel preferred configurations of CM veneer blocks, whereby such blocks may be cut by workmen in the field to one of a number of different lengths for wall sections which do not conform in size to established modular sizes for conventional building exterior walls, as below discussed.

Such CM block veneer wall cladding constructions can be readily constructed by dry mechanical assembly of the CM veneer blocks by unskilled workers without mortar with the CM veneer blocks being mechanically locked and held in place. This eliminates the need for more expensive bricklayers or masonry artisans of any particular type. In fact, the construction of such CM veneer block wall claddings can be "do-it-yourself".

Such types of CM veneer block wall cladding constructions can be used to retrofit to existing substrate walls. That would be done by simply mounting the CM blocks on the exterior walls of an existing building to form the CM block veneer wall cladding thereon as herein disclosed.

The disclosed CM veneer blocks used in such CM block veneer wall cladding constructions disclosed in the drawings and described below can be made with standard existing equipment by ready modification of conventional concrete block machine molds as hereinafter discussed. This is an important advantage for commercialization of these inventions.

It is an object of the invention to provide preferred configurations of concrete masonry veneer blocks for use in construction of concrete masonry block veneer wall claddings whereby such blocks can be cut by workmen in the field to provide a large number of different lengths to apply to substrate wall sections which do not conform to modular size. It is a related object to provide a few such CM veneer block configurations which can be cut to satisfy almost all likely requirements in field usage. It is another related object of the invention to provide concrete masonry veneer blocks of particular advantageous configurations for use on inside and outside corners of substrate walls in constructing a CM veneer block wall cladding on a building according to the present invention.

BRIEF DESCRIPTION OF THE DRAWINGS

The above and other related objects and advantages of the present inventions will become apparent from the following description and specification, appended claims and drawings wherein:

in FIG. 1 and related Figures the concrete block veneer wall cladding is shown mounted on an exterior building wall.

FIG. 10 shows a plan view of a suitable configuration of concrete masonry veneer blocks for *outside* corner use with the wall constructions shown in FIGS. 1–2 and 10; and FIG. 10 also shows a plan view of a suitable configuration of concrete masonry veneer block for use on the *inside* corners of a wall construction such as shown in FIGS. 1–2 and 10. FIG. 10 also shows outside and inside corner blocks which can be cut by workmen in the field to provide one of a substantial number of different lengths to apply respectively to outside and inside corners of substrate wall sections which do not conform to established modular size as discussed below.

in FIG. 17 and related Figures the concrete block veneer wall cladding is shown mounted on an exterior building wall.

FIG. 30 shows a plan view of a suitable configuration of concrete masonry veneer blocks for outside corner use with the wall constructions shown in FIGS. 17 and 18; and FIG. 30 also shows a plan view of a suitable configuration of concrete masonry veneer block for use on the inside corners of a wall construction such as shown in FIGS. 17 and 18. FIG. 30 also shows outside and inside corner blocks which can be cut by workmen in the field to provide one of a substantial number of different lengths to apply respectively to outside and inside corners of substrate wall sections which do not conform to established modular size as discussed below.

DETAILED DESCRIPTION WITH REFERENCE TO FIGS. 1-16

Figure 1:
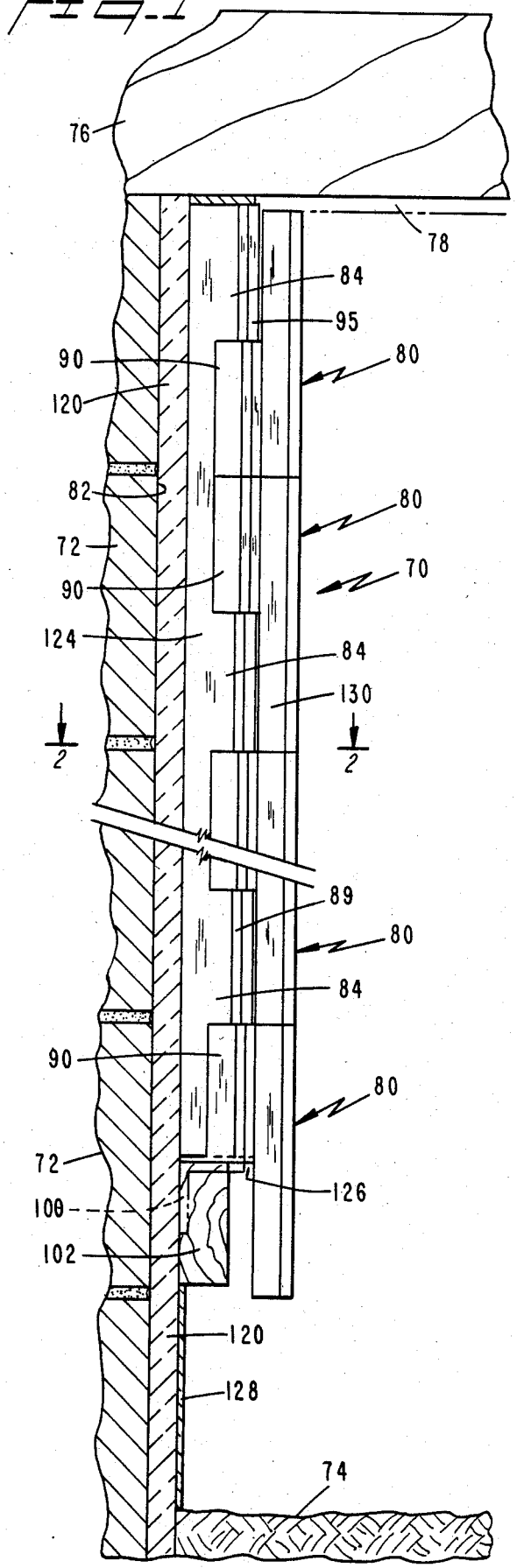
FIG. 1 is a vertical partly side elevation, partly cross-sectional view (taken along line 1—1 in FIG. 2) showing an embodiment of the present inventions in which a concrete masonry block veneer wall cladding comprising concrete masonry blocks is mounted on a side of a building substrate wall of any kind.
Figure 2:
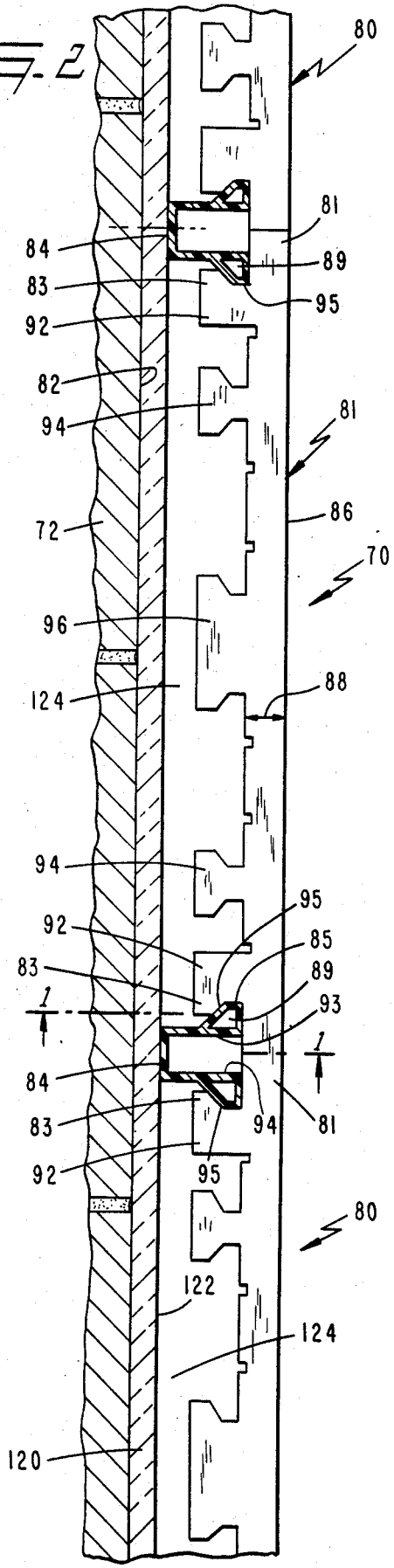
FIG. 2 is a partly sectional, partly plan view of the CM block veneer wall shown in FIG. 1 taken along line 2—2 in FIG. 1, and showing a plan configuration of the concrete masonry veneer blocks.
Figure 3:
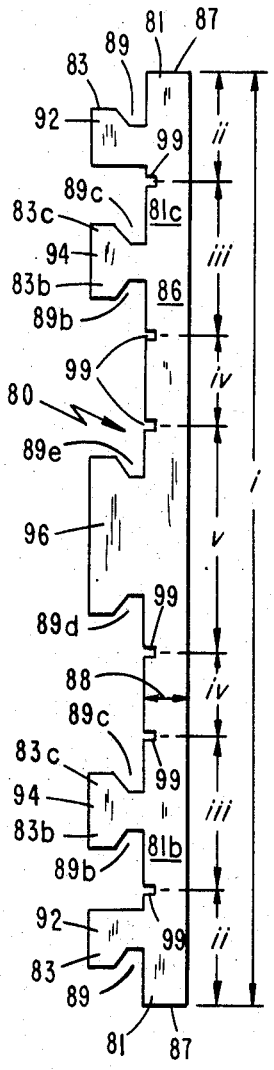
FIG. 3 is a plan view of a suitable configuration of concrete masonry veneer blocks for use in the wall cladding construction shown in FIGS. 1 and 2 whereby the CM veneer blocks can be cut by workmen in the field to provide one of a large number of different lengths to apply to a substrate wall portion which does not conform to established modular size as discussed below.
Figure 5:
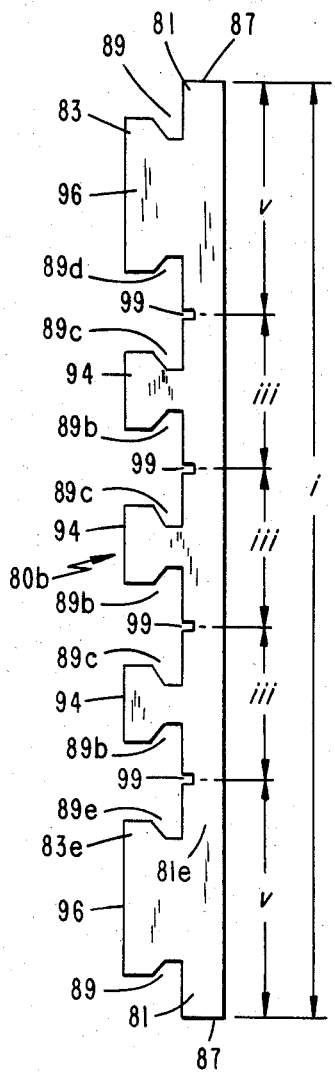
FIG. 5 is a plan view of still another configuration of concrete masonry veneer blocks which may be cut in the field to adjust to different wall sizes varying from established modular dimension.
Figure 6:
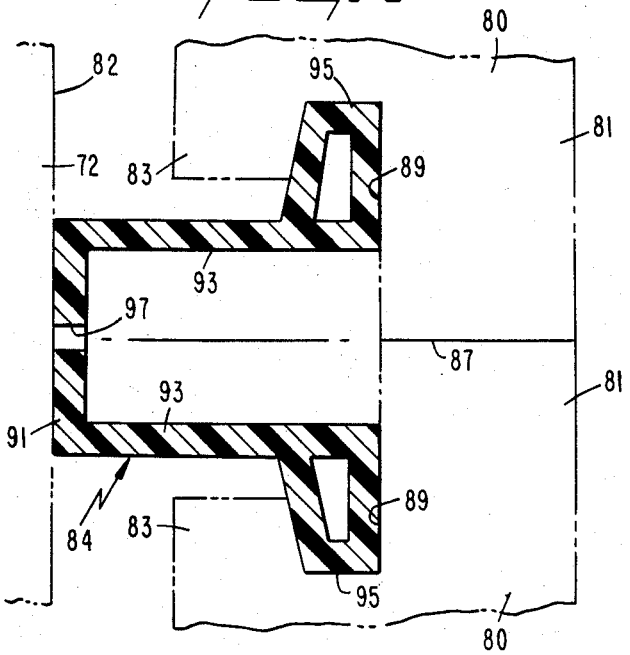
FIG. 6 is a fragmentary partly sectional and partly plan view taken along line 2—2 in FIG. 1 showing a plastic batten for mounting concrete masonry veneer blocks to construct a veneer wall cladding such as shown in FIGS. 1 and 2 as explained below.

Reference is now made particularly to FIGS. 1, 2 and 6 (and also FIGS. 3-5, 7, 9, and 10-16) for the following description of construction of a concrete masonry block veneer wall cladding made from CM veneer blocks according to the present invention. In FIGS. 1 and 2 there is shown a section of CM veneer block wall cladding generally indicated at 70 mounted on a new or existing substrate wall 72 which is shown in FIGS. 2 and 3 as made up of conventional concrete masonry blocks. However, substrate walls 72 can be made of any type of conventional wall construction such as bricks, wood or steel, etc. The substrate wall 72 extends vertically above grade 74, and the top of the substrate wall 72 may in turn support rafters 76 and soffits 78.

Concrete masonry veneer blocks generally indicated by arrow 80 in FIGS. 1-3 are mounted on the exterior surface 82 of building substrate wall 72 by means of a plurality of vertically extending battens 84 which are secured to the outside of substrate wall 72 by any suitable fastening means such as nails, etc. The configuration of concrete masonry veneer blocks 80 used in the concrete masonry block veneer wall construction 70 of FIGS. 1-2 will be apparent from the drawings and the disclosure herein. The CM veneer blocks indicated generally at 80 have a substantially rectangular shape in front elevation as will be apparent from FIGS. 1-3. As especially shown in FIG. 1, in end elevation the CM veneer blocks 80 have a generally L-shaped configuration. The front facing section 86 of the block 80 extends along the horizontal length of the block and is of substantially uniform thickness along the length of the block as indicated at 88 in FIGS. 1 and 3 (and other drawings). The upper rear portion of CM veneer block 80 indicated at 90 in FIG. 1 includes a plurality of rearwardly projecting members such as indicated at 92, 94 and 96 in FIGS. 2 and 3 (i.e., such members constitute the upper rear block portion 90). Rear block portion 90 extends downwardly partway from the top of the block 80; in the embodiment as shown in FIG. 1, rear block portion 90 extends downwardly from the top of block 80 about one-half of the height of a block. Referring particularly to FIGS. 2 and 3, each block 80 has at opposite ends thereof a pair of vertically extending flanges 81 and 83 which form end dovetail grooves 89 vertically extending down the upper half 90 of CM veneer block 80 behind the block's front facing section 86. Each of dovetail grooves 89 at each block end 87 is adapted to receive a laterally projecting flange 95 which extends laterally from and vertically along each batten 84 as shown in FIGS. 1 and 6 and further explained below.

Reference is now made especially to FIG. 6 which shows in detail the cross-section of batten 84 shown illustratively in FIGS. 2 and 1. FIG. 6 discloses an embodiment of batten made of plastic material suitable for the purpose and comprising a channel cross-section which includes an end wall mounting section 91 and side portions 93, plus integrally formed retainer flanges 95 extending laterally from side sections 93, with series of openings 97 in part 91 for securing the batten 84 to substrate wall 72 by any suitable fastener means. The plastic batten 84 is flexible whereby legs 93 may flex inward to pass inner end flange 83 of a block 80 and then spring out whereby the two lateral flanges 95 of battens 84 are received and locked in dovetail grooves 89 of two adjacent blocks 80 with the end surfaces 87 of said blocks 80 adjacent to or abutting each other. The plastic batten 84 is made of any suitable length so that the batten 84 can be mounted vertically on substrate wall 72 extending the vertical length thereof so that a series of CM veneer blocks 80 can be mounted on the battens to form a CM veneer block wall cladding 70 in a manner which will be apparent from FIGS. 1, 2 and 6 and the description herein.

Referring particularly to FIG. 1, an angle or other structural steel shape 100 and/or a treated wood sill support 102 is anchored to the substrate wall 72 to support the weight of the CM veneer block wall cladding 70 formed by CM veneer blocks 80 stacked verticallly on top of each other as shown particularly in FIG. 1. Since the battens 84 are secured to the substrate wall 72 by suitable fastener means, the batten flanges 95 extending into dovetail grooves 89 at opposite ends of the CM veneer blocks 80 serve to hold the blocks 80 against horizontal force and thereby retain blocks 80 on the substrate wall 72 in conjunction with the vertical supports 100 and/or 102 so as to form CM veneer block wall cladding 70. If necessary or desirable, an adhesive can be applied to grooves 89 of the blocks 80 and/or to the flanges 95 of the battens 84 to enhance retention of the veneer blocks 80 by means of flanges 95 on battens 84. The number of CM veneer blocks 80 which could be mounted in a given vertical course of blocks depends on the weight of the blocks 80 and in turn on the block size and density of the concrete masonry mixture of the blocks as related to the load-bearing capacity of members 100 and/or 102. In general, with present technology, battens such as shown at 84 are made of a length sufficient for extending vertically up to about 12 feet and are suitable for most commercial installations, although appropriate variations from this length would be apparent in light of the disclosure herein and are further explained below.

In assembling the CM veneer blocks 80 to the existing substrate wall 72, the lowermost block 80 is installed on a pair of adjacent vertically extending battens 84 with the bottom of the rearwardly extending portion 90 of block 80 resting on the angle 100 and/or wood sill 102. Each course of blocks 80 is assembled by successively stacking blocks 80 on top of each other and locking each block 80 between the two adjacent battens 84 by flexing the legs 93 of battens 84 so as to insert the batten flanges 89 into, and cause them to lock in, dovetail grooves 85 at each of the opposite ends of each block 80. The various courses of CM veneer blocks 80 are assembled in such manner to construct CM veneer block cladding 70 working upward until the course of blocks just below the top course of blocks has been installed. In FIG. 1, the top block 80 of each course is shown installed vertically inverted with the enlarged rearwardly extending portion 90 disposed down, rather than disposed upward like the bottom block (and other blocks below the top block). It is noted that the top blocks 80 will be installed thus inverted when using a wood batten such as disclosed in FIG. 9 for building a CM veneer block wall with such a wood batten, as further discussed below. However, when using a batten such as disclosed in FIGS. 6 and 2, or alternative battens such as disclosed in FIGS. 7 and 8 described below, each of top blocks 80 may be installed with the enlarged rear section 90 disposed vertically upward the same as the blocks 80 below; that is, the top block 80 shown in FIG. 1 may be disposed so that the rearwardly extending portion 90 thereof is at the top of that block, the same as the blocks 80 below said top block. However, even using battens such as shown in FIGS. 6 and 7–8, structural impediments at or below the building roof may make it necessary or desirable to install the top veneer blocks inverted as shown in FIG. 1 using a method like or analogous to that for installing CM veneer blocks using wood battens according to FIG. 9 as further described below.

The lower and upper surfaces of the CM veneer blocks 80 will abut closely against the adjacent upper or lower surfaces of the next adjoining CM block(s), as the case may be. Also, vertical side end surfaces 87 on the front facing flanges 81 of the CM veneer blocks 80 will be adjacent to or abut against the like side end surfaces 87 of adjoining blocks 80. In constructing a CM veneer block wall cladding 70 according to FIGS. 1, 2 and 6, the CM veneer blocks 80 may be dry stacked or the upper, lower and side joints between such blocks 80 may be adhered together.

Figure 7:
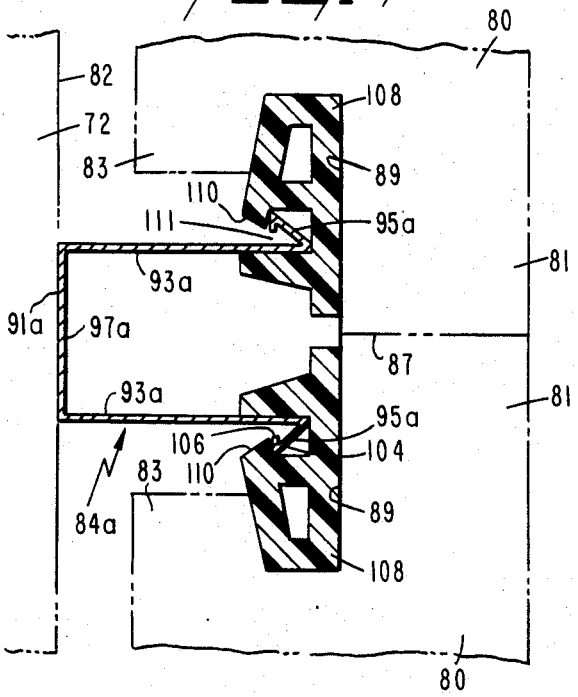
FIG. 7 is a fragmentary partly sectional and partly plan view similar to FIG. 6 but showing a second alternative type batten comprising a metal channel plus a plastic (or metal) retainer means for mounting the concrete masonry veneer blocks as described below.

Reference is now made to FIG. 7 which discloses another embodiment of combination metal batten with plastic or metal retainer means usable in a manner analogous to the batten 84 of FIG. 6 for constructing a CM veneer block wall cladding 70 as discussed with reference to FIGS. 1, 2 and 6. The batten embodiment shown in FIG. 7 is generally indicated at **84*a*; portions of batten 84*a* in FIG. 7 which are the same as batten 84 in FIGS. 6 and 2 are identified with like numerals and/or letters, whereas portions of the batten 84*a* in FIG. 7 which are analogous to, or a close variation of, portions of the batten 84 of FIG. 6 are identified by like numerals plus a different subscript letter. The batten 84*a* of FIG. 7 includes a metal channel which has an end wall 91*a*, side walls 93*a*, and a series of fastener openings 97*a* for securing the batten 84*a* to the face 82 of a substrate wall 72. Side walls 93*a* of the metal channel member of batten 84*a* have clip ends 95*a* which include a longer section 104 and a shorter section 106. The described metal channel portion of batten 84*a* could be made of standard steel stock such as 16–20 gauge steel. Plastic or metal retainer members 108 of a configuration such as shown in FIG. 7 are preinserted and secured in the dovetail recesses 89 at the ends of blocks 80 at the factory or in the field, and are held in place by force fit, friction or adhesive or any other suitable means. The dimension of the small lug 106 on the end of the metal channel side 93*a* is approximately equal to and preferably slightly less than the spacing 111 between the end of each small lug portion 106 and the outside of the adjacent channel sidewall 93*a* to permit the clip end parts 104 and 106 to be forced inwardly past the edges 110 of the retainer members 108 and then spring out to lock the involved parts in position. The CM veneer blocks 80 are installed on and locked to adjacent pairs of battens 84*a* which are secured to substrate wall 72 to build courses of CM veneer blocks 80 and CM veneer block wall cladding 70 similar to that shown in FIGS. 1 and 2, in a manner analogous to the assembly of the CM veneer blocks 80 using the plastic battens 84 as described above with reference to FIGS. 1, 2 and 6. In using battens 84*a* , it may or may not be necessary to invert the top blocks 80 as noted in the foregoing description of construction of CM veneer block wall cladding 70 using the plastic batten 84 of FIG. 6. The above discussion of construction of a CM veneer block wall cladding 70 with reference to FIGS. 1, 2 and 6 using the batten of FIG. 6 is applicable to building a CM veneer block wall cladding 70 using the batten 84*a* of FIG. 7** and thus will not be repeated here.

Figure 8:
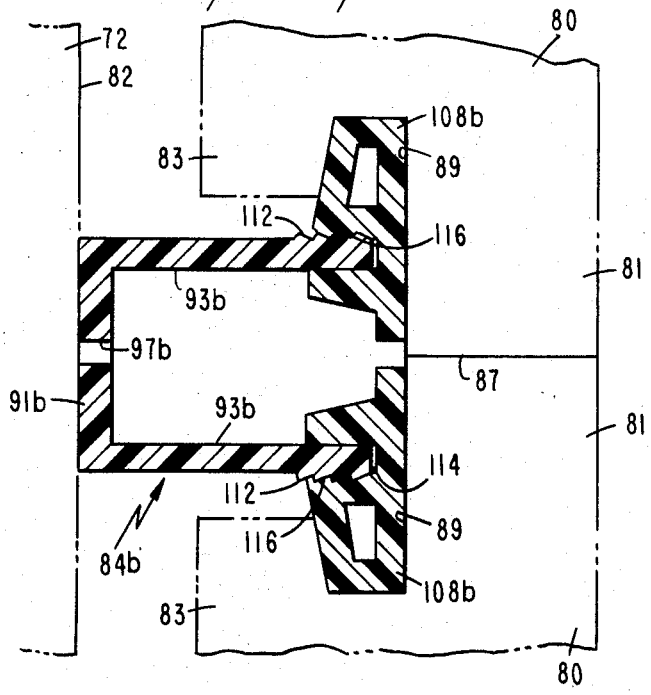
FIG. 8 is a fragmentary partly sectional and partly plan view similar to FIGS. 6 and 7 but showing a third alternative plastic batten for mounting the concrete masonry veneer blocks as described below .

Reference is now made to FIG. 8 which discloses another form of snap-on batten which may be made of plastic or metal, but is likely to be made of plastic as in the embodiment disclosed in FIG. 8. This batten modification is generally indicated as **84*b* and includes components which are like or analogous to or variations of parts of the batten embodiments disclosed in FIGS. 6 and 7. Parts of the batten embodiments of FIG. 8 which are the same as the batten of FIGS. 6 and 7 are identified with like numerals, and parts which are analogous to or close variations of components of the battens of FIG. 6 and/or FIG. 7 are identified by like numerals with different letter subscripts. Batten 84*b* includes a channel portion having an end wall 91*b* and two side walls 93*b* with ratchet teeth 112 at the end of each channel wall 93*b*, and a series of fastener openings 97*b* in the end wall for readily securing the channel portion of the batten 84*b* to the exterior of the substrate wall 72. Plastic inserts 108*b* are pre-installed in the dovetail recesses 89 at the ends of the CM veneer blocks 80 in the factory or in the field. The inserts 108*b* may be held in the blocks by press-fit or friction, or with adhesive if necessary or desirable. Each plastic block 108*b* has a recess 114 which has ratchet teeth 116 for engaging teeth 112 on said channel portion of batten 84*b*. The plastic of said channel portion and the plastic of the inserts 108*b* would be made of dual durometer (measure of hardness) so that the plastic of one part would be hard enough to snap into and lock with the plastic of the other part which would be resilient enough to allow insertion. In constructing a CM veneer block wall cladding 70 using the battens 84***b* according to FIG. 8, the batten channel portions would be vertically secured to the wall at suitably spaced intervals to the building exterior substrate wall 72, and the CM veneer blocks 80 including inserts 108*b* would be simply pressed on to the channel portions of two adjacent battens 84*b* and thereby held in place. The blocks would be stacked vertically upward from the supporting angle 100 and/or sill 102, as shown in FIG. 1 and as discussed with reference to FIGS. 1, 2 and 6. However, the top blocks 80 of a CM veneer wall cladding 70 made with battens 84*b* such as shown in FIG. 8 may be installed with the enlarged block portion 90 upward rather than downward (as shown in FIG. 1), as is the case for walls made with the battens 84 of FIG. 6 or the battens 84*a* of FIG. 7 as above discussed. However, in some instances it may be necessary or desirable to install the top blocks (and other blocks above the bottom block) in inverted position as shown in FIG. 1 as explained in the above discussion of the embodiment of FIGS. 1, 2 and 6. The above discussion of construction of a CM veneer block wall cladding 70 with reference to FIGS. 1, 2 and 6 is applicable to building such a wall cladding with battens 84*b* of FIG. 8 and thus is not repeated here.

Figure 9:
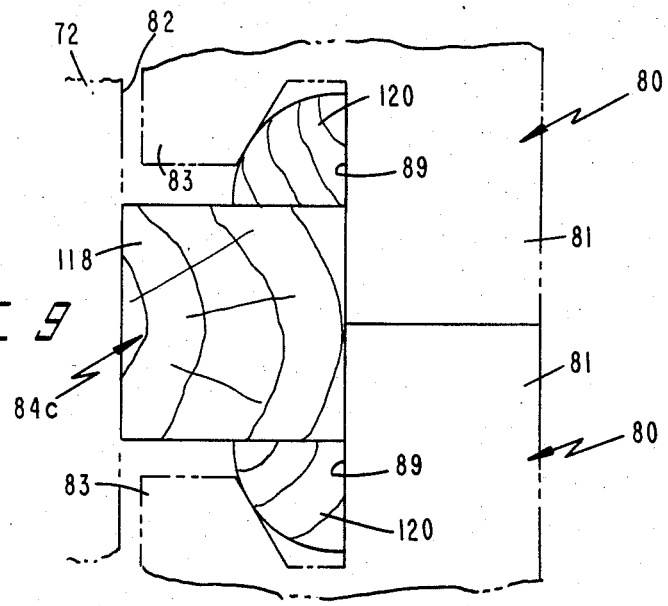
FIG. 9 is a fragmentary partly sectional and partly plan view similar to FIGS. 6-8 showing a fourth alternative batten made of wood for mounting the concrete masonry veneer blocks to construct a veneer wall cladding as discussed below.

Reference is now made to FIG. 9 which shows still another type of batten generally indicated at 84*c* which may be used to construct a CM veneer block wall cladding 70 such as disclosed in FIGS. 1 and 2, as now explained. Batten 84*c* includes a length of lumber 118, which typically may be 2"×2" construction lumber; and elongated wood piece 118 is adapted to be secured to the face 82 of a building exterior wall substrate 72 in vertical position by any suitable fasteners. Batten member 118 has secured to each side thereof a plurality of vertically spaced members 120 which are positioned adjacent the edges of wood piece 118 and provide retainer members or flanges for mounting the CM veneer blocks 80; retainer members 120 may be ¾-inch, quarter-round pieces nailed to the sides of the elongated main batten members 118. Each of the retainer members 120 may be of a length substantially equal to the length of the upper rearwardly projecting portion 90 of the CM veneer block 80 and thus substantially equal to one-half the vertical height of the CM veneer block 80. In that event, such retainer or flange members 120 are mounted on the sides of elongated wood portion 118 of batten 84*c* at vertially spaced intervals, with the lowest retainer sections 120 being mounted adjacent the bottom of batten member 118 so that it will be disposed just above the vertical support angle 100 and/or stud 102 shown in FIG. 1. Pairs of retainer members 120 are mounted at opposite sides of the elongated wood portion 118 of each batten 84*c* and of the adjacent battens 84*a* at vertically spaced intervals so that the CM veneer blocks 80 may be installed by laterally moving the rearward projection of each block 80 between the spaced ends of wood portions 118 of battens 84*c* and then letting blocks 80 slide down so that the blocks 80 are sequentially secured to wall 72 by block dovetail grooves 89 being inserted over and locked onto the retainer members 120 of battens 84*c*. A CM veneer wall cladding 70 is thus constructed per this embodiment in a manner which will be apparent to those skilled in the art in light of the disclosure herein. Referring especially to FIG. 1, when using such a wood batten 84*c* according to FIG. 9, the CM blocks 80 at the top of the wall are installed inverted with larger rear portion 90 downward as shown in that figure. It is noted that the retainer members 120 on the sides of wood batten pieces 118 may alternatively be of a length substantially equal to the height of 2 or 3 stacked blocks with the lowermost member 120 adjacent the bottom of batten piece 118. Additional such retainer members 120 would be installed on the sides of batten members 118 so that there is a space between the ends of such retainer members of a dimension slightly greater than one-half the height of a CM veneer block 80. Then 2 or 3 blocks 80 could be secured to wall 72 by block grooves 89 being inserted over and lowered and locked onto such elongated retainer members 120 of multiple block height, as will be apparent to one skilled in the art in light of the disclosure herein. The installation of the CM blocks 80 and particularly top CM blocks 80 using battens 84*c* according to this embodiment of FIGS. 1, 2 and 9 is carried out in a manner analogous to that disclosed and described with reference to the embodiment of FIGS. 1–5 of my said parent application Ser. No. 570,684 which disclosure is incorporated herein by reference.

Reference is made again particularly to FIGS. 1 and 2 for discussion of additional features of a CM veneer block wall cladding 70 and installation thereof according to the present invention. A coating of insulation generally indicated at 120 is preferably applied to the outer surface of building exterior wall substrate 72; this may be conventional rigid insulation of a type known in the art. The insulation 120 is preferably also provided with a reflective surface indicated at 122 which is conventional in the art. The battens 84 are securely fastened to the building exterior wall substrate 72 by fastening means (not shown) penetrating through the insulation 120 into the wall substrate 72. The battens 84 (or alternate type battens 84*a*, 84*b* and 84*c* above described) are so dimensioned and the components of CM veneer blocks 80 are so dimensioned that when the CM veneer blocks 80 are mounted on the building exterior wall substrate 72, there is an air gap or space generally indicated at 124 between the back surfaces of the CM veneer blocks 80 and the wall 72 (and also insulation layer 120 when such insulation is used). The air space 124 also permits drainage of any water which may condense behind the CM veneer block wall cladding 70 formed by the CM blocks 80; and openings indicated at 126 are provided at the bottom of the CM veneer block wall cladding 70 with clearance between the inner portions of the CM veneer block wall cladding 70 and the support angle 100 and/or wood sill 102 thereby permitting condensed moisture to drain to grade indicated at 74 in FIG. 1. The use of battens and CM veneer blocks 80 configured and dimensioned so as to provide air space 124 in conjunction with insulation 120 and reflective surface 122 provides better insulation. Still referring to FIG. 1, the angle 100 and/or treated wood sill 102 anchored to the exterior wall 72 to provide means supporting the CM veneer block wall 70 is preferably located above grade level 74 for drainage of condensed water and sometimes for other reasons. A protective coating 128 is applied to building exterior wall 72 over insulation 120; coating 128 preferably is waterproof and sometimes otherwise treated for various protective purposes.

Using good current practice, the CM veneer blocks 80 (and CM veneer blocks 80*a* and 80*b* of FIGS. 4 and 5) would be made with a concrete cementitious materal averaging 100 lbs/cu. ft. density or more. The thickness 88 of the main rectangular front face section 86 of the block 80 would be at least about 1 inch to provide above discussed advantages while also making it possible to meet other requirements with respect to strength, weight, convenience of use in the field, etc. The dimensions of respective parts of the block would be governed in part by the weight that can be handled by one workman in the field. With presently available materials and according to present practice, it is contemplated that the CM veneer block 80 (or CM veneer blocks 80*a* and 80*b*) would have an overall thickness of about $2\frac{5}{8}$ inch for the upper part 90 shown in side elevation in FIG. 1 and indicated at 118 in plan in FIG. 2, with a thickness of about $1\frac{1}{4}$ inch for the lower part of the block indicated in side elevation at 130 in FIG. 1 and in plan at 88 in FIG. 2. With these dimensions and for a modular length of 24 inches as herein discussed, the CM block 80 would have an overall height (vertical dimension in FIG. 1) of 4 inches, 6 inches or 8 inches. The weight of CM veneer block 80 (or block 80*a* or 80*b*) with disclosed configuration and above indicated dimensions would be approximately 15–21 lbs., with the weight varying according to the nature of the mix.

The CM veneer block wall cladding disclosed herein may readily be applied to the wall of a typical house. The CM veneer block wall cladding disclosed herein can also be used to build CM veneer block walls on the exterior walls of a high-rise building. However, in a high-rise building, a plurality of supports like angles 100 and/or treated wood sills 102 shown anchored to the wall in FIG. 1 would be provided at vertically spaced intervals extending horizontally along each wall to sustain the weight of the portion of the CM veneer block wall cladding 70 formed by the blocks supported by each such horizontal support means. In general, with presently available materials and present state of the art, such supports like angle 100 and/or wood sill 102 can support a column of CM veneer blocks about 12 ft. high. Thus, the vertical extent of CM wall cladding section between each of such horizontal sets of block supports (angle or treated wood sill or the like) would be about 12 ft. or less and would accommodate a suitable number of courses of veneer blocks 80 (or blocks 80*a* or 80*b* of FIGS. 4–5) according to the height of such blocks, which is determined in light of factors discussed herein. It is noted that the materials usable for making such CM veneer blocks, and the dimensions thereof, and the number of courses which can be stacked on a given set of such horizontal supports (like 100 and/or 102) may vary depending on future developments in the art.

In conventional building construction, exterior walls are built on the basis of industry-established modular size, which in the U.S.A. involves a basic 4-inch module and 24-inch length of concrete block or like exterior wall construction materials. Similarly, in other major developed countries using the metric system, comparable exterior walls are built using a comparable metric modular length of 60 cm instead of 24 inches. In construction in the field, however, the dimensions of some exterior wall sections will depart from the target modular size. It is therefore highly desirable to provide CM veneer block configurations for constructing CM veneer block wall cladding according to this invention whereby such CM veneer blocks may be conveniently cut by workmen in the field to one of the number of different lengths for wall sections of varying dimensions not conforming to established modular size.

Figure 4:
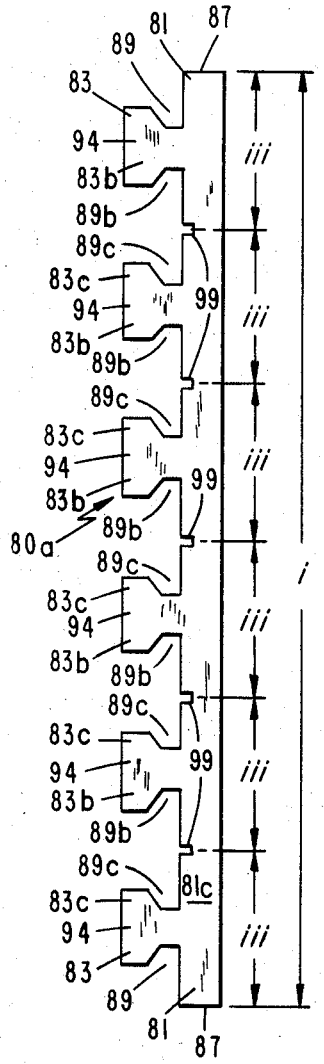
FIG. 4 is a plan view of an alternate configuration of the concrete masonry veneer blocks for use in the wall construction of FIGS. 1-2, whereby the CM veneer blocks can be cut in the field to one of a number of different dimensions for use in completing wall sections which do not meet established modular size.

Reference is now made particularly to FIGS. 3, 4 and 5 which show three preferred CM veneer block configurations each of which may be cut to one of a number of different sizes. (The configuration of CM veneer block shown in FIG. 3 is the same as that in FIG. 2 but is repeated for convenience of more detailed explanation).

Reference is now made particularly to FIG. 3 showing a plan view of the configuration of CM veneer block 80. The CM veneer block 80 includes at the ends thereof two similarly shaped sections 92 extending rearwardly from the front face portion 86 of block 80 near ends 87 thereof and also two similarly shaped sections 94 extending rearwardly from the front facing portion 86 of block 80 and positioned near said rearward projections 92. Block 80 also includes a centrally located projection 96 which on the opposite sides thereof is configured in plan similar to projections 94, but differs in that projection 96 has a central portion thereof extending along the length of block 80 a greater distance than the central portion of projections 94. The block 80 is scored or notched at different lengths from ends 87 as indicated at 99. (While FIG. 3 shows such notches 99, these are markings to indicate where to cut the block 80 to one of a number of different lengths varying from modular size, and the blocks 80 may be equivalently marked in a different manner. A score or notch or like marking which may be applied during the molding of the CM veneer block 80 in a concrete masonry casting machine is preferable.)

The overall length of the CM veneer block 80 is indicated at i in FIG. 3 and is equal to said standard modular block dimension (which is 24 inches in the U.S.A., and 60 cm in developed metric countries). In the configuration of FIG. 3, the first notch 99 nearest each block end 87 is spaced a distance ii from end 87; the notch 99 second from each block end 87 is spaced from the immediately preceding notch 99 a distance iii; the notch 99 third from each block end 87 is spaced from the immediately preceding notch 99 a distance iv; and there is a central spacing v between the two innermost notches 99. In a preferred U.S.A. commercial embodiment CM veneer block 80 using such configuration of FIG. 3: Dimension i would be 24 inches; dimension ii would be 3 inches; dimension iii would be 4 inches; dimension iv would be 2 inches; and dimension v would be 6 inches. It is therefore possible to cut the CM veneer block 80 having such configuration and dimensions at one of the notches 99 so as to provide a CM veneer block length of 4 inches, or 6 inches, or 7 inches, or 8 inches, or 9 inches, or 12 inches, or 14 inches, or 15 inches, or 17 inches, or 18 inches, or 21 inches, as well as 24 inches.

Referring still particularly to FIG. 3, it is noted that end projection 92 has a plan configuration so that when the block 80 is cut at the adjacent notch 99, there will be provided a pair of vertically extending flanges 83*b* and 81*b* which form a new end dovetail groove 89*b* vertically extending down the upper half of CM veneer block 80. This new end dovetail groove 89*b* is adapted to receive one of the laterally extending flanges 95 of batten 84 in like manner as shown in FIGS. 2 and 6 and described above with reference to FIGS. 1, 2 and 6. When the like projection 92 is similarly cut at score 99 nearest the other end of the block, that will provide a new pair of vertically extending flanges 81*c* and 83*c* forming a new dovetail end groove 89*c* vertically extending down the upper half of the CM veneer block. New end dovetail groove 89*c* is similarly adapted to receive the laterally extending flange 95 of a batten 84 on that side of the block 80 thus cut. Accordingly, block 80 which is cut at either or both such notches can be installed on adjacent battens spaced on a wall less than original block length in like manner as an uncut block 80 as discussed above with reference to FIGS. 1, 2 and 6 (assuming use of a batten like 84 shown in FIG. 6). It also will be apparent to those skilled in the art that assuming use of alternate battens such as shown in FIGS. 7, 8 and 9 described above, the thus cut block 80*b* with a new end dovetail groove 89*b* and/or 89*c* will be analogously mounted on adjacent battens in a manner apparent to those skilled in the art in light of the disclosure herein. Further, the block 80 shown in FIG. 3 can be cut at any of the other notches 99 so as to provide one or two new end dovetail retaining grooves, which may be any one or two of the other dovetail grooves indicated at 89*b*, 89*c*, 89*d* and 89*e* at one side of either projections 94 or projection 96 in FIG. 3. Such new end dovetail retaining grooves can be used to mount the thus cut block 80 on the laterally extending projection 95 of adjacent battens 84 shown in FIGS. 2 and 6 (or similarly on adjacent battens shown in FIGS. 7, 8 or 9 described above). Thus, the CM veneer block 80 having a configuration and dimensional arrangement according to FIG. 3 as above described may be cut in the field to provide a CM veneer block of any one of the different lengths stated in the last sentence of the immediately preceding paragraph; and the thus cut CM veneer blocks have end flanges forming end dovetail grooves for mounting the resultant blocks of different length on two adjacent battens vertically mounted on the outside of an exterior building wall a corresponding non-modular distance.

Reference is now made particularly to FIG. 4 which shows a plan view of a configuration of CM block generally indicated at 80*a* which is a modification of the above described CM veneer block 80 shown in FIGS. 2 and 3. Portions of the CM veneer block 80*a* in FIG. 4 which are the same as in CM veneer block 80 in FIG. 3 are identified with like numerals and/or letters; and portions of the CM veneer block 80*a* in FIG. 4 which are analogous to or a close variation of portions of the CM veneer block 80 in FIG. 3 are identified by like numerals plus a different subscript letter. The overall length of the CM veneer block 80*a* of FIG. 4 is modular dimension i, the same as for CM veneer block 80 of FIG. 3. The CM veneer block 80*a* shown in FIG. 4 has six rearwardly projecting members 94 which have a plan configuration as shown in FIG. 4 (these are of like configuration as member 94 shown in the CM veneer block 80 of FIG. 3). Notches or scores 99 are provided on the block 80*a* as shown in FIG. 4, and these notches are spaced said distance iii from the ends 87 of the block 80*a* and from each other as shown in FIG. 4. When CM veneer block 80*a* is cut at any of notches 99 then (a) that will provide new vertically extending flanges 81*c* and 83*c* which form a dovetail groove 89*c* vertically extending down the upper half of the CM veneer block 80*a* behind the block's front face section 86 thereby providing a new end dovetail groove for mounting on a batten at such new end of the block, or (b) it will provide a pair of new vertically extending flanges 81*c* and 83*c* forming a dovetail groove 89*c* vertically extending down the upper half of the CM veneer block 80*a* providing a new end groove for mounting such new end of the block on a batten, with case (a) or (b), depending on which notch 99 is cut. Such resultant new end dovetail groove(s) 89*b* or 89*c*, as the case may be, are each adapted to receive a lateral projecting flange 95 of batten 84 (or like retainer means of other type battens disclosed) in the dovetail ends of a block 80*a* thus cut whereby the block 80*b* thus modified may be installed on two adjacent battens spaced at a comparable distance less than the standard modular distance —in a manner apparent to one skilled in the art from the description herein with reference to FIGS. 1–3, and 6–9. The configuration of CM veneer block 80*a* of FIG. 4 provides alternate cut block sections having a length of 4 inches, or 8 inches, or 12 inches, or 16 inches, or 20 inches, as well as 24 inches (based on length iii being 4 inches and length i being 24 inches for U.S.A. use).

Reference is now made particularly to FIG. 5 which shows a plan view of still another configuration of CM veneer block generally indicated at 80*b* . The CM veneer block 80*b* includes many components the same as in the CM veneer block 80 of FIG. 3 and/or the CM veneer block 80*a* of FIG. 4. Parts of the CM veneer block modification 80*b* of FIG. 4 which are the same as the CM veneer block 80 of FIG. 3 and/or of the CM veneer block 80*a* of FIG. 4 are identified with like numerals; and parts which are analogous to, or close variation of, components of the CM veneer blocks 80 and/or 80*a* of FIGS. 3 and 4 are identified with like numerals with different letter subscripts. The CM veneer block 80*b* of FIG. 5 includes three rearwardly projecting members 94 having a configuration as shown (which is like that of the projections shown at 94 in the embodiments of FIGS. 3 and 4) plus two end projections 96 having a configuration as shown (which is like that of projection 96 in the embodiment of FIG. 3). Notches or scores 99 are provided as shown to mark where block 80*b* is to be cut. Each of the notches 99 nearest the respective ends 87 of the block 80*b* are spaced said distance v from ends 87, and the next two notches 99 are spaced said distance iii from the notch nearest each end and from each other. In this embodiment of FIG. 5, dimension iii is 4 inches and dimension v is 6 inches. The CM veneer block 80*b* may be cut at one of the various notches 99 to yield a non-standard length of 6 inches, or 10 inches, or 14 inches, or 18 inches, as well as 24 inches. Depending at which notch(es) 99 the CM veneer block 80*b* is cut, there will be provided (a) new end flanges 81*b* and 83*b* forming new vertical end dovetail grooves 89*b*, or (b) new end flanges 81*c* and 83*c* forming new vertical end dovetail grooves 89*c*, or (c) new end flanges 81*d* and 83*d* forming new vertical end dovetail grooves 89*d*, or (d) new end flanges 81*e* and 83*e* forming new vertical end dovetail grooves 89*e*. The resultant one or two new block end dovetail grooves 89*b*, 89*c*, 89*d*, or 89*e*, as the case may be, will extend vertically down the upper half of the thus cut CM veneer block 80*b* . Each such end dovetail groove is adapted to receive laterally extending projection 95 of a batten 84 (or equivalent means of other type battens) affixed to the exterior wall 72 as above discussed with reference to FIGS. 1, 2 and 6–9 plus 3 and 4. The thus cut CM block 80*b* can be installed on two adjacent battens spaced less than modular length at a distance corresponding to any of the above-stated resultant cut block lengths, in a manner as above described with reference to the embodiments 80*a* and 80*b* in FIGS. 2–4.

The three CM veneer blocks of different configurations according to FIGS. 3, 4 and 5 make it possible to use only three different versions of modular length blocks for CM veneer block wall cladding which can be cut in the field to a large number of different lengths probably satisfying the various non-modular spacings between the battens likely to be encountered in the field. With the particular configurations and dimensional relationships of CM veneer blocks 80, 80*a* and 80*b* of FIGS. 3, 4 and 5, respectively, such blocks can be cut in the field to provide blocks of the following lengths: 4 inches, 6 inches, 7 inches, 8 inches, 9 inches, 10 inches, 12 inches, 14 inches, 15 inches, 16 inches, 17 inches, 18 inches, 20 inches, or 21 inches, as well as 24 inches.

Figures 10, 11, 12:
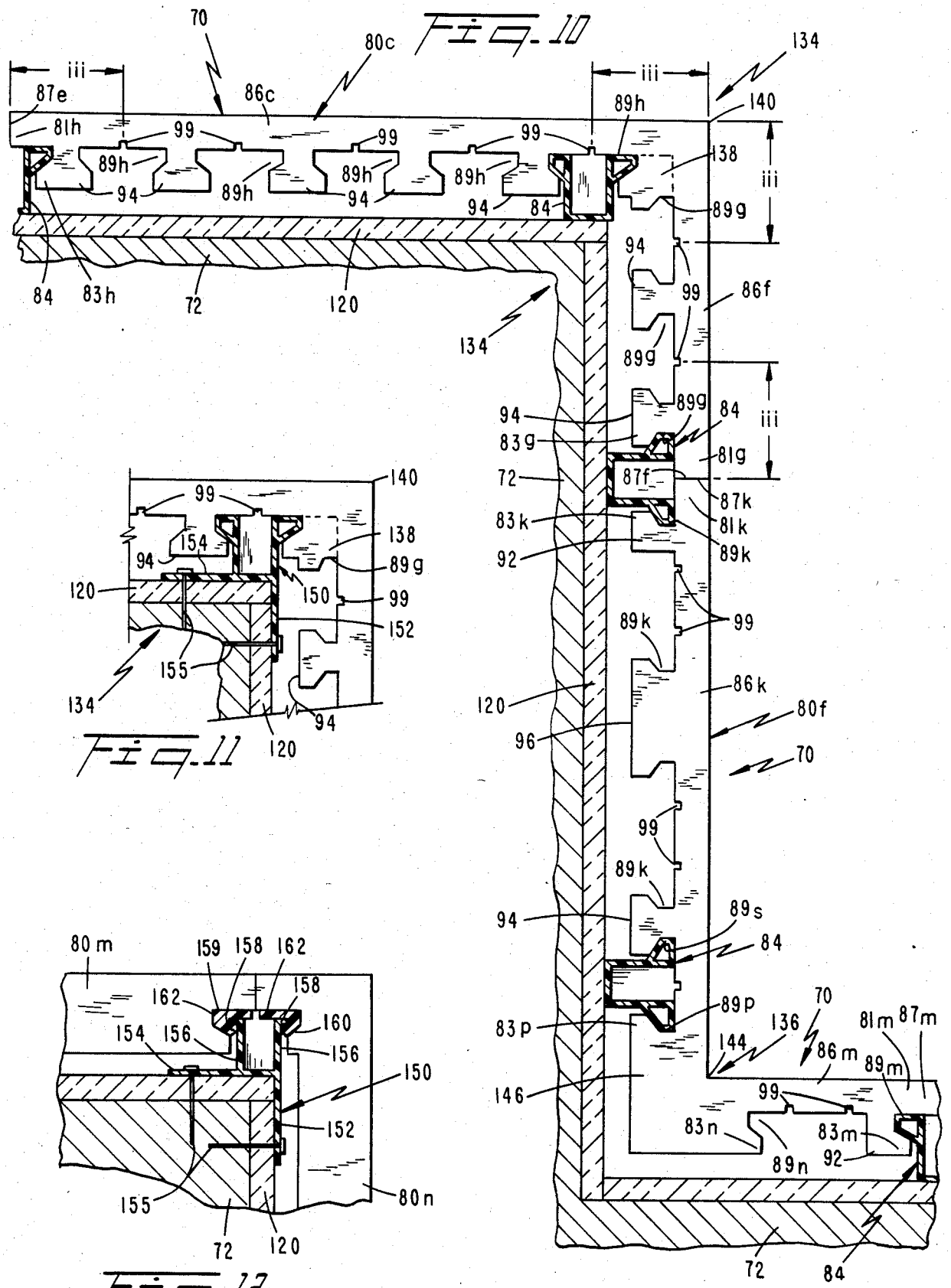
FIG. 10 is a partly sectional and partly plan view of a corner of a building incorporating concrete masonry veneer block wall cladding such as shown in FIGS. 1–2, with FIG. 10 showing modified CM veneer blocks for use on outside and inside corners at the junction of two substrate walls.
FIG. 11 is a partly cross-sectional and partly plan view of an exterior corner generally similar to that shown in FIG. 10, but showing a modified configuration of a special batten for use in applying such exterior corner blocks to an outside corner of two walls constructed according to FIGS. 1–2 and 10.
FIG. 12 is a partly cross-sectional and partly plan view generally similar to that shown in FIG. 10, but showing modified configuration exterior corner CM veneer blocks and also showing a special batten for use in applying such corner blocks to an outside corner of two walls constructed according to FIGS. 1–2 and 10.

Reference is now made to FIG. 10 which is a partly sectional and partly plan elevation view of two corners of a building incorporating concrete masonry veneer block walls 70 installed on building exterior substrate walls 72 like CM veneer block wall cladding 70 disclosed in FIGS. 1 and 2 and described above with reference thereto. In FIG. 10 three building walls 72 intersect to form corners such as would be included in a typical building exterior wall construction. A representative "outside corner" is generally indicated at 134 and a representative "inside corner" is generally indicated at 136. Components of the wall and corner construction arrangement shown in FIG. 10 which are the same as components of the wall construction shown in FIGS. 1 and 2 plus 6, and portions of the CM veneer blocks shown in FIGS. 3–5, are identified by like numerals and/or letters; and parts which are analogous to, or a close variation of, parts of the construction and components shown in said Figures are identified by like numerals plus a different subscript letter. Each wall section making up the corners 134 and 136 as shown in FIG. 10 is constructed in like manner as the wall section disclosed in FIGS. 1, 2 and 6. Each wall section includes building exterior substrate walls 72, a layer of insulation 120 and a plurality of battens 84 vertically secured by fasteners to the outside of each building exterior wall 72 at suitable laterally spaced intervals in like manner as disclosed above with respect to FIGS. 1, 2 and 6 in a manner apparent to one skilled in the art in light of the disclosure herein (whereby further details of the wall sections shown in FIG. 10 are not repeated here).

Reference is particularly made to the outside corner CM veneer block generally indicated at 80*c* at the top of FIG. 10. Outside corner block 80*c* shown in plan view is of generally L-shape configuration and includes a longer front facing side 86*c*which has an end face 87*e* plus a shorter facing side 86*f* which has an end face 87*f*. The longer facing side 86*c* of corner block 80*c* has a length of modular dimension between end face 87*e* and corner point 134 (24 inches in the U.S.A.). The shorter facing side 86*f* has a length between end face 87*f* and corner point 134 based on the basic module of 4 inches in the U.S.A., and preferably would be half the length of facing side 86*c* (or 12 inches in the U.S.A.).

Reference is now made to the configuration of CM veneer corner block 80*c* shown in FIG. 10 with cross reference also to FIGS. 1–5. The CM veneer corner block 80*c* includes a plurality of projections 94 extending rearwardly from the front facing side portions 86*c* and 86*f*, with such projections 94 extending from the top of the block 80*c* substantially half way down the height of the block in like manner as projections 94 described above with reference to the CM veneer block embodiments 80, 80*a* and 80*b* disclosed in FIGS. 1–5. There is also at the junction of the two front facing side portions 86*c* and 86*f* (sometimes called "corner block legs") an inside corner projection having a configuration as shown at 138 in FIG. 10. The outside corner block 80*c* is scored or notched at different lengths from each of ends 87*c* and 87*f* as shown in FIG. 10 to provide markings indicating where to cut either both sides 86*c* and/or 86*f* of the block 80*c* in the field to provide one of the number of different lengths varying from the modular size of corner block leg 86*c* or the half-modular size of corner block leg 86*f*. In the configuration of outside corner block 80*c* shown in FIG. 10, the first notch 99 nearest end 87*c* of longer leg 86*c* is spaced from end 87*c* a distance iii, and the first notch nearest end 87*f* of the shorter leg 86*f* is likewise spaced from end 87*f* a distance iii, as indicated in FIG. 10. The first notch 99 nearest the outer corner junction 140 in FIG. 10 is spaced therefrom a distance iii on both longer and shorter legs 86*c* and 86*f* as shown in FIG. 10. All the other notches 99 on the longer and shorter legs 86*c* and 86*f* are spaced from each other notch a like distance iii. In a preferred U.S.A. commercial embodiment of CM veneer corner block 80*c* shown in FIG. 10 dimensions iii will be 4 inches. It is therefore possible to cut the CM veneer corner block 80*c* in FIG. 10 at any one of the notches indicated by numeral 99 in FIG. 10 so as to modify longer leg 86*c* of block 80*c* to a length of 4 inches, or 8 inches, or 12 inches, or 16 inches, or 20 inches, as well as 24 inches. It is also possible to cut the shorter leg 86*f* of block 80*c* configuration to provide a length of 4 inches, or 8 inches, as well as 12 inches.

Referring still particularly to the outside corner CM veneer block 80*c* shown in FIG. 10, rearwardly extending projection 94 adjacent the end 87*e* of the longer leg 86*c* has a configuration and is located so as to provide a pair of vertically extending flanges 81*h* and 83*h* extending down the upper half of the CM veneer corner block 80*c*. Similarly, the rearwardly extending projection 94 adjacent the end 87*f* of the shorter leg 86*f* of block 80*c* has a configuration and is located near end 87*f* so as to form a pair of vertically extending flanges 81*g* and 83*g* which form a dovetail groove 89*g* vertically extending down the upper half of CM veneer corner block 80*c*. These dovetail grooves 89*h* and 89*g* receive one of the laterally extending flanges 95 of batten 84 as illustrated in FIG. 10 to mount the corner block 80*c* in a like manner as shown and described with reference to FIGS. 1, 2 and 6 above. When the longer leg 86*c* of corner block 80*c* is cut at any of notches 99 on that leg there will be provided a new end pair of vertically extending flanges which are similar to flanges 81*h* and 83*h* and form a new end dovetail groove such as indicated at 89*h* in FIG. 10. This new end dovetail groove 89*h* is adapted to receive the laterally extending flange 95 of a batten 84 on that side of the thus cut block for mounting the altered corner block 80*c* between two battens 84 spaced apart a non-modular distance, in a manner apparent to those skilled in the art from the disclosure herein. In analogous manner, the shorter side of corner block 80*c* indicated at 86*f* may be cut at either of the two notches 99 shown in FIG. 10 and that will provide a new pair of vertically extending end flanges similar to end flanges 81*g* and 83*g* forming a new end dovetail groove 89*g* vertically extending down the upper half of the back CM veneer corner block 80*c* on leg 86*f*. Accordingly, the thus cut block can be installed on a laterally extending flange 95 of a batten 84 so that block leg 86*c* thus cut can be mounted with battens spaced less than the original half-modular dimension of leg 86*f*. As shown in FIG. 10, inside corner portion 138 provides similar grooves indicated at 89*h* and 89*g* at corner section 138;

and these grooves can be used to mount a short corner portion cut at either or both notches 99 closest to corner portion 138 on each leg 86*c* and/or 86*f*. Also, with use of alternate battens such as shown in FIGS. 7, 8 and 9 described above, the legs 86*c* and/or 86*f* of CM veneer corner block 80*c* may be similarly cut to different lengths with resultant end grooves so that they may be analogously mounted on such other type battens non-modularly spaced, in a manner apparent to those skilled in the art in light of the disclosure herein.

Figures 13, 14, 15, 16:
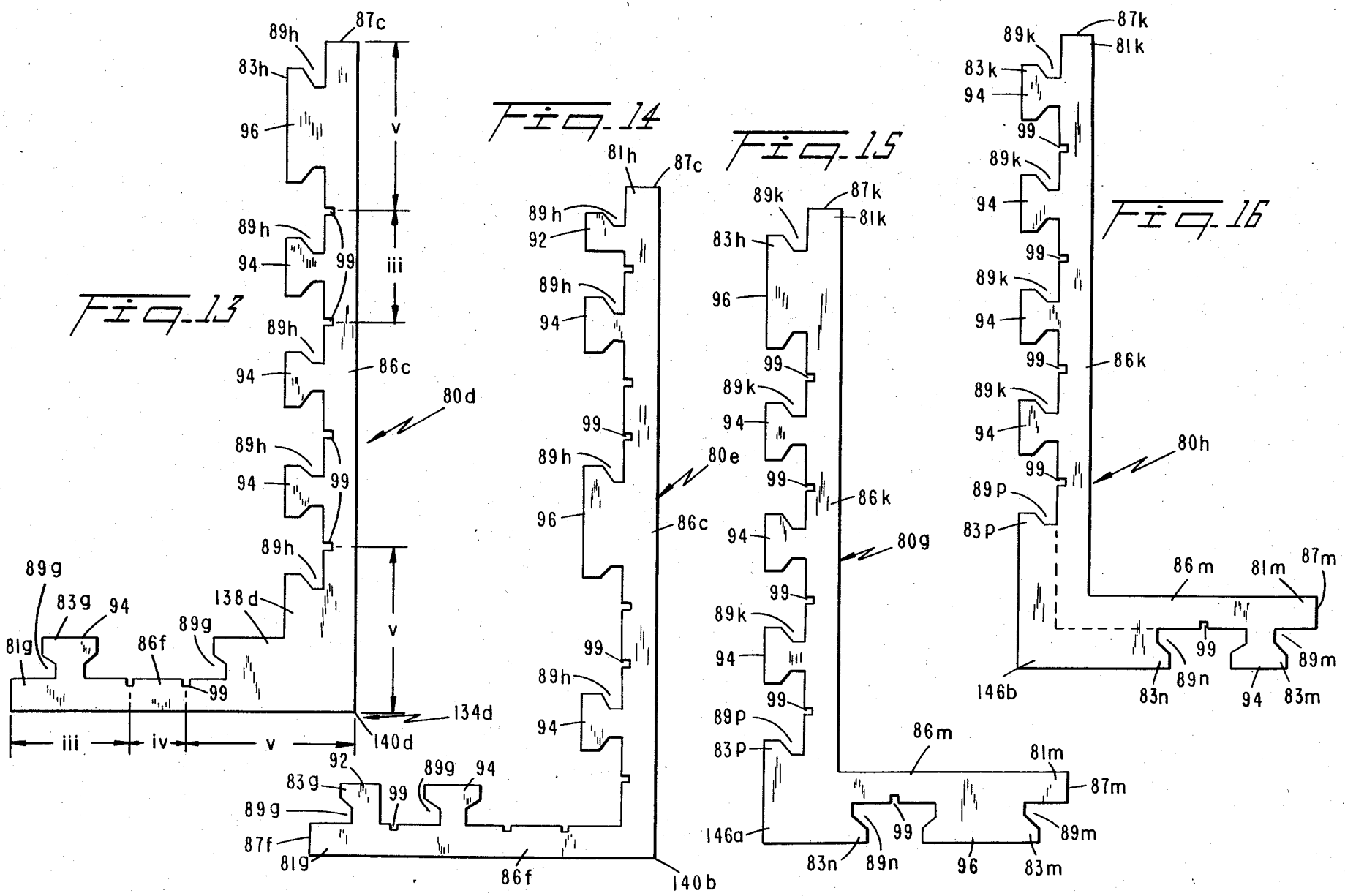
FIG. 13 is a plan view of an alternate configuration of CM veneer blocks for use on the outside corners of wall cladding construction according to FIGS. 1, 2 and 10; this outside block configuration is usable in lieu of the outside block configuration shown in FIG. 10 and similarly can be cut in the field to one of a number of different non-modular dimensions.
FIG. 14 is a plan view of still another configuration of concrete masonry veneer blocks for the outside corners of wall cladding construction according to FIGS. 1, 2 and 10, and this block configuration may also be cut in the field to one of a number of different non-modular lengths.
FIG. 15 is a plan view of an alternate configuration of such concrete masonry veneer blocks for use on the inside corners of a wall cladding construction according to FIGS. 1, 2 and 10; this inside block configuration is usable in lieu of the inside block configuration shown in FIG. 10 and also can be cut in the field to one of a number of different non-modular dimensions.
FIG. 16 is a plan view of still another configuration of concrete masonry veneer blocks for use in the inside corners of a wall cladding construction according to FIGS. 1, 2 and 10, and this configuration may also be cut in the field to complete corner wall sections varying from established modular dimension.

Reference is now made to FIGS. 13 and 14 which show plan views of configurations of modifications of the outside corner CM veneer block 80*c* shown in FIG. 10 (and above described with reference thereto), so as to provide alternate CM veneer corner block configurations whereby one or both sides or legs thereof may be cut to different lengths in the field. The outside corner CM veneer block of FIG. 13 is indicated generally at 80*d* and the outside CM veneer corner block of FIG. 14 is indicated generally at 80*e*. In FIG. 13, portions of the CM veneer block 80*d* which are the same as in CM veneer block 80*c* shown in FIG. 10 are identified with like numerals and/or letters; and portions of the CM veneer block 80*d* which are analogous or a close variation of the portions of the CM veneer block 80*c* in FIG. 10 are identified by like numerals plus a different subscript letter. In FIG. 14, the same approach is taken for identification of parts of the veneer block 80*e* which are like or analogous variations of corresponding parts of the veneer blocks 80*c* of FIG. 10 and/or 80*d* of FIG. 13.

Reference is now made particularly to FIG. 13 which shows in plan view the configuration of an outside corner CM veneer block generally indicated at 80*d* which is like the corner veneer block 80*c* of FIG. 10 subject to differences noted below. The longer facing side or leg 86*c* is of modular size and has three rearwardly projecting members 94 of configuration as shown with another projection 96 near the end 87*c* of block side 86*c*. (Such projection 96 is similar to projections 96 in FIGS. 3 and 5 above described). The shorter corner block leg 86*f* has a rearwardly extending projection 94 near leg end 87*f*. At the inside of the corner 134*d* where the two sides 86*c* and 86*f* of block 80*d* are joined, there is a projection 138*d* of configuration as shown in FIG. 13. The block is provided with a plurality of scores or notches 99 on the inside of each of 86*c* and 86*f* to indicate where the block may be cut to provide one of a different number of lengths varying from standard modular dimension of side 86*c* or the ½ modular dimension of side 86*f*. As shown in FIG. 13, the first notch 99 is spaced from end 87*c* a distance v; the second notch 99 is spaced from the first notch of side 86*c* a distance iii; the other notches 99 on side 86*c* are spaced from each other a like distance iii (not shown in the drawings), and the notch 99 on side 86 closest to the corner is spaced distance v from corner junction 148. On the shorter side 86*f* the first notch is spaced from corner 140 a distance v, and another notch 99 on side 86*f* is spaced from end 87*f* a distance iii, with a resultant spacing iv between the notches on side 86*f*. For U.S.A. use, the overall length of the block 80*d* would be 24 inches, dimension iii would be 4 inches, dimension iv would be 2 inches, and dimension v would be 6 inches. The CM veneer corner block modification 80*d* of FIG. 13 may be cut at one of notches 99 to provide a variety of different veneer block lengths for side 86*c* which may be 6 inches, or 10 inches, or 14 inches, or 18 inches, as well as 24 inches. This will provide, where the notch 99 is cut, a new end surface 87*c* with new end projections 81*h* and 83*h* forming a new end dovetail groove 89*h* vertically extending down the upper half of the back of leg 86*c* with new end dovetail groove 89*h* being adapted to receive the laterally extending flange 95 of a batten 84 on that side of the block thus cut so as to mount the modified block on such batten spaced less than modular distance from the corner 140 of the block. The shorter side 86*f* of CM veneer corner embodiment 80*d* may also be cut at the notch 99 closest to the corner 140*f* to provide new end retaining flanges and a new end dovetail retaining groove 89*g* for mounting that end of the thus modified corner block 80*d* on the flange 95 of a batten 84 on that side of the block so as to mount the modified block on such batten spaced less than half modular distance from the corner 140; this would be a distance v in FIG. 13, or 6 inches. As shown in FIG. 13 with reference to FIG. 10, the inside corner portion indicated at 138*d* provides end dovetail grooves 89*g* and/or 89*h*, if sides 86*c* and/or 86*f* are cut at the closest notches, in like manner as explained for inside corner section of block 80*d* of FIG. 10. The installation of the modified CM veneer corner block 80*d* according to FIG. 13 on battens 84 analogous to corner block 80*c* as shown in FIG. 10 as described above will be apparent to those skilled in the art in light of the disclosure herein, as will also be the use of block 80*d* with alternate battens such as shown in FIGS. 7, 8 and 9 described above.

Reference is now made particularly to FIG. 14 which shows in plan view the configuration of another embodiment of outside corner CM veneer block generally indicated at 80*e* which is like the above described outside corner blocks 80*c* and 80*d* of FIGS. 10 and 13, subject to differences in detail now described. The longer side 86*c* of the corner block 80*e* of FIG. 14 includes rearwardly extending projections 94 and 96 (which are like projections 94 and 96 of blocks 86*c* and 86*d* in FIGS. 10 and 13) and rearwardly extending projection 92 adjacent end 87*c* (projection 92 is like projection 92 adjacent the ends of CM veneer block 40 shown in FIGS. 2 and 3 and described above). The shorter facing side 86*f* has similar rearwardly extending projections 94 and 92. These rearwardly extending projections 92, 94 and 96 extend vertically down the upper half of the CM block 86*c* behind the front facing block sections 86*c* and 86*f*. Near end 87*c* of leg 86*c* are a pair of flanges 81*h* and 83*h* which form an end dovetail groove 89*h*, and near end 87*f* of leg 86*f* there are like flanges 81*g* and 83*g* forming a like dovetail groove 89*g*, said dovetail grooves extending vertically down one half the height of the block 80*e*. End dovetail grooves 89*h* and 89*g* are used to mount the corner block 80*e* on a pair of battens 84 having flanges 95 received in such grooves in like manner as the corner block 80*c* shown in FIG. 10 and described above. The longer side 86*c* of corner block 80*e* may be cut at any one of the notches indicated by numeral 99 in FIG. 14 to provide a new end dovetail groove 89*h* formed by new end flanges similar to flanges 81*h* and 83*h*, with such new end dovetail groove 89*h* being located a distance from corner 140*b* depending on which notch 99 is cut. Similarly, the shorter side 86*f* may be cut at the notch indicated by numeral 99 in FIG. 14 to provide a new end dovetail groove 89*g* on that leg of the corner block 80*e* for purposes of securing same to the flange 95 of a batten 84. The CM veneer corner block 80*e* thus cut on either or both sides 86*c* and/or 86*f* is then mounted by securing the resultant end dovetail grooves on a laterally extending flange 95 of two adjacent battens 84 which are spaced less than the original modular dimension 86*c* and/or less than the original half modular dimension of side 86*f*. The notches indicated by numerals 99 in FIG. 13 are spaced from corner point 140*b* so that the side 86*c* can be cut to a length of 7 inches, or 15 inches, or 22 inches, as well as being 24 inches. The notch indicated at 99 on side 86*f* in FIG. 14 is located so that this side can be cut to a length of 9 inches, as well as 12 inches. Again, it will be apparent to those skilled in the art that alternative battens such as shown in FIGS. 7, 8 and 9 can be used in lieu of the batten of FIG. 6 for mounting corner block 80*e* with either or both sides 86*c* and 86*f* uncut or cut.

Referring to FIGS. 13 and 14, it is noted that there are some notches shown in these drawings but not identified by numerals 99 in those Figures. Those not-identified notches cannot be used to make short leg sections for use as outside corner CM block portions to mount between batten space other than modular size. They can provide straight block portions of varying length according to the spacing of the notches cut, and thus usable similar to short sections made from CM veneer blocks 80, 80*a* and 80 shown in FIGS. 3–5, as above discussed.

Reference is now made again particularly to FIG. 10 to more specifically describe an embodiment of inside corner CM veneer block generally indicated at 80*f* and installed at an inside corner formed by intersecting substrate walls 72 and generally indicated at 136 in the lower portion of FIG. 10. Inside corner block 80*f* shown in plan view is generally L-shaped and includes a longer front facing section 86*k* which has an end face 87*k* and a shorter side 86*m* which has an end face 87*m*. The length of the longer side 86*k* from end 87*k* to corner point 144 in FIG. 10 is a multiple of the basic 4-inch module in the U.S.A.; and in a typical embodiment such length would be 20 inches. The length of shorter side 86*m* from end 87*m* to corner point 144 would also be a multiple of the basic 4-inch module in the U.S.A.; and in a typical embodiment such length would be 8 inches. The longer facing side 86*c* of inside corner block 80*f* has a plurality of projections 92, 94 and 96 extending rearwardly thereof with such projections extending from the top of the block 80*f* to substantially halfway down the block. (Said projections are like the projections 92, 94 and 96 of the blocks of FIGS. 10, 13 and 14 and of FIGS. 3–5 described above). The projection 92 on block side 86*k* provides end flanges 81*k* and 83*k* which form an end dovetail groove 89*k* extending halfway down the back of the block, and the projection 92 at the end of block section 86*m* provides similar end flanges 81*m* and 83*m* forming like end dovetail groove 89*m* extending halfway down the block. The inside corner block 80*f* includes a corner section 146 which provides flanges 83*n* and 83*p* forming dovetail grooves 89*n* and 89*p* as shown in FIG. 10. The inside veneer corner block 80*f* is mounted on battens shown at 84 in FIG. 10 by means of the dovetail grooves 89*k*, 89*s* and *89p* and 89*m* receiving laterally projecting flanges 95 of battens 84 vertically secured to building exterior substrate wall 72 at suitably spaced lateral intervals (in like manner as described above with reference to FIGS. 1, 2 and 6). The shorter side 86*m* may be cut at the notch indicated at 99 in FIG. 10; this will provide a new dovetail groove 89*n* at the end of cut section 86*m*. The longer side 86*k* of the CM veneer corner block 80*f* may be cut at any of the three notches indicated at 99 in FIG. 10. This will provide a new end dovetail groove at 89*p*, or 89*r* or 89*s* depending on which notch 99 is cut. Inside corner block 80*f* thus cut on one or both sides 86*k* and/or 86*m* can be installed on battens 84 spaced apart less than the original standard length, in a manner analogous to similarly cut outside corner blocks 80*c*, 80*d* and 80*e* as discussed above with reference to FIGS. 10, 13 and 14 plus FIGS. 1, 2 and 6.

Reference is now made to FIGS. 15 and 16 which show in plan view configurations of modifications of the CM veneer inside block 80*f* shown in FIG. 10 and described above with reference thereto. FIGS. 15 and 16 respectively show alternative inside CM veneer corner block configurations 80*g* and 80*h* which may be cut to additional different lengths of sides in the field. Portions of block 80*g* of FIG. 15 and of block 80*h* of FIG. 16 which are the same as parts of inside corner CM veneer block 80*f* in FIG. 10 are identified with like numerals and/or letters, and portions of the CM veneer blocks 80*g* and 80*h* of FIGS. 15 and 16 which are analogous to, or a close variation of, portions of block 80*f* in FIG. 10 are identified by like numerals plus a different subscript letter.

Reference is now made particularly to FIG. 15 which shows in plan view a generally L-shaped inside corner CM veneer block generally indicated at 80*g* which is much like the inside corner veneer block 80*f* shown in FIG. 10 and above described, subject to some differences in detail noted below. The longer facing side or leg 86*k* of block 80*g* is provided with a plurality of rearwardly projecting members 94 of configuration as shown plus a rearward projection 96 of configuration as shown near end 87*k*. The shorter facing side 86*m* is provided with a projection of configuration 96 as shown. The corner portion of block 80*g* shown at 146*a* is similar to corner portion 146 of block 80*f* shown in FIG. 10, but in the embodiment of FIG. 15 corner portion 146*a* is of smaller dimension along each side. Inside corner portion 146*s* has ends configured to provide flanges 83*n* and 83*p* and grooves 89*n* and 89*p* as shown in FIG. 15 (and like the corresponding parts similarly identified as to inside corner block 80*f* in FIG. 10). All projections 94, 96 extend vertically halfway down the rear of the block and thus also the end dovetail grooves formed by such projections indicated at 89*k* and 89*m*. The longer facing side 86*k* may be cut at any one of the notches indicated by 99 in FIG. 15, and this will provide one of four different lengths of side 86*k* in addition to the original length thereof. It will provide a new end groove such as shown at 89*k* or at 83*p* depending on which notch 99 is cut on side 86*k*. The shorter side 86*m* may be cut at the notch 99 to provide a shorter length for this side besides the initial length and this will provide a new end groove as shown at 89*n*. The inside corner block 80*g* cut at a notch 99 on one or both sides 86*k* and/or 86*m* is then mounted on walls 72 by securing said resulting new end grooves to laterally projecting portions 95 of battens 84 which are spaced apart less than the standard distance in like manner as inside corner block 80f as will be apparent to those skilled in the art in light of the disclosure herein.

Reference is now made particularly to FIG. 16 which shows in plan view still another embodiment of inside corner CM veneer block generally indicated at 80*h*, which is generally L-shaped and is much like the above described inside corner blocks 80*f* and 80*g* shown in FIGS. 10 and 15, subject to differences in details such as now described. The longer side 86*k* of the corner block 80*h* in FIG. 16 includes a plurality of rearwardly extending projections 94 (which are like projections 94 of inside corner blocks 80*f* and 80*g* previously described with reference to FIGS. and 15). The shorter side section 86*m* of block 80*h* includes near end 81*m* a rearwardly extending projection 94. A plurality of notches or scores showing where the block should be cut for different lengths are provided as indicated by numerals 99 in FIG. 16. The corner section of block 80*h* indicated at 146*b* is similar to the corresponding corner portions 146*a* and 146*b* of locks 80*f* and 80*g*, but differs in length. Corner portion 146*b* is provided with flanges 83*n* and 83*p* as shown in FIG. 16 (corresponding to like identified flanges of block 80*f* shown in FIG. 10). Other parts of the inside corner block embodiment 80*h* of FIG. 16 identified by like numerals as for block 80*f* shown in FIG. 10 are the same as such corresponding components in FIG. 10. The longer block side 86*k* can be cut at any of the notches indicated by numerals 99 to provide any one of four different lengths besides the original molded length of side 86*k*. (The five different lengths of side 86*k* thus provided by the embodiment of FIG. 16 will differ from the five different legs of side 86*k* thus provided by cutting the block embodiment of 80*g* of FIG. 15.) The shorter side 86*m* of the corner block embodiment 80*k* in FIG. 16 may be cut at 99 in the field to provide a different length besides the base molded length of side 86*m*. (Again, such second wall length thus provided with the embodiment of FIG. 16 will differ from the second wall length provided by cutting the short leg of the embodiment of FIG. 15.) Cutting longer section 86*k* at one of notches 99 will provide a new end dovetail groove such as indicated at 89*k* or 89*p*, depending on which notch 99 is cut. Cutting the short side 86*m* at score 99 will provide a new end dovetail recess such as indicated at 89*n*. One or both of such new end dovetail grooves is used to mount the thus cut and modified corner block 80*h* on a pair of battens 84 with the laterally extending projections 95 thereof being received in such newly provided end dovetail grooves. The thus modified corner block section 80*h* may be mounted on adjacent battens spaced apart less than the standard molded block size(s), in like manner as corner block 80*f* shown in FIG. 10 and in a manner which will be apparent to those skilled in the art in light of the disclosure herein.

Reference is now made particularly to FIG. 11 which is a partly cross-sectional and partly plan view substantially like that of FIG. 10 but showing a modified configuration of batten for use in applying such exterior corner blocks to an outside corner of two intersecting substrate walls 72 like as shown in FIG. 10 with reference to FIGS. 1 and 2; reference is also made to FIG. 15 for explanation of the modified corner batten shown in FIG. 11 and generally indicated at 151. Corner batten 151 has a cross-sectional configuration such as shown in FIG. 11 and includes a U-shaped portion configured like that of batten 84 shown in FIG. 6 and described above plus two sides 151 and 153 extending laterally from the base of said U-shaped portion. Each of said two sides 151 and 153 is secured to the intersecting substrate walls 72 at an exterior corner by nails or other fastening means shown at 155.

Reference is now made particularly to FIG. 12 which is a partly cross-sectional and partly plan view generally similar to that of FIGS. 11 and 10 but showing different configuration exterior corner blocks and also showing another corner batten embodiment for use in applying such corner blocks to an outside corner of two intersecting substrate walls 72 like as shown in FIG. 10 with reference to FIGS. 1 and 2; reference is also made to FIG. 8 to facilitate explanation of details of the corner batten shown in FIG. 12 and generally indicated at 150. Corner batten 150 has a cross-sectional configuration such as shown in FIG. 12 and includes two sides 152 and 154 adapted to be secured to the intersecting walls 70 at a corner by nails or other fastening means shown at 155 with two walls 156 projecting from said side 154 at substantially right angles thereto to provide a channel-shaped batten section which is similar in construction and analogous to the corresponding parts of batten 84*b* shown in FIG. 8 (see end 91*b* and sides 93*b* in FIG. 8). In this modification, the ends of sides 156 are provided with ratchet teeth 158 which are similar to the above described ratchet teeth at 112 in the batten 84*b* of FIG. 8. The end of CM block 80*m* in FIG. 12 may be constructed like that of any of the CM veneer blocks 80, 80*a*, and 80*b* shown in FIGS. 3–4 and similarly provided with a vertically extending groove 159 at the end of said block for securing it to part of batten 150 (see FIG. 12 together with FIG. 2 and description relating thereto). A CM veneer block 80*n* having a modified end and a modified corner groove such as shown at 160 in FIG. 12 is provided for use with the special corner batten shown in FIG. 12. A pair of plastic inserts 162 similar to inserts 108*d* shown in FIG. 8 are each mounted in the groove 159 at the end of block 80*m* and in the groove 160 at the end of block 80*n*. Each of these inserts 162 thus mounted on the ends of blocks 80*m* and 80*n* is provided with ratchet teeth similar to the ratchet teeth 116 shown in FIG. 8 and engaging said ratchet teeth shown at 158 in FIG. 12. The blocks 80*m* and 80*n* are installed onto the special batten 150 by engaging said ratchet teeth of said inserts 160 on the ratchet teeth 158 of the channel wall portions 156 of special corner batten 150 in like manner as discussed above with respect to applying CM blocks 80 in a wall construction according to FIGS. 1 and 2 but using battens according to FIG. 8 in lieu of the battens according to FIG. 6 as discussed above. The nature of the construction of the components of the embodiment shown in FIG. 12 and the manner of installation thereof will be apparent to one skilled in the art from the foregoing description of FIG. 12 with reference to the previous description of FIGS. 1, 2, 10, 6 and 8.

The CM veneer blocks shown in FIGS. 1–5 and 10–16 can readily be provided with various types of decorative surfaces (not shown) using existing equipment and existing type concrete masonry mixes. The CM veneer blocks 80, 80*a* and 80*b* lend themselves to making a new improved veneer block wall cladding which provides a good functional finish and other advantages, and they can be used to upgrade simple concrete block exterior wall constructions or other types of conventional wall constructions.

DETAILED DESCRIPTION OF PREFERRED EMBODIMENT OF FIGURES 17–34

Figure 17:
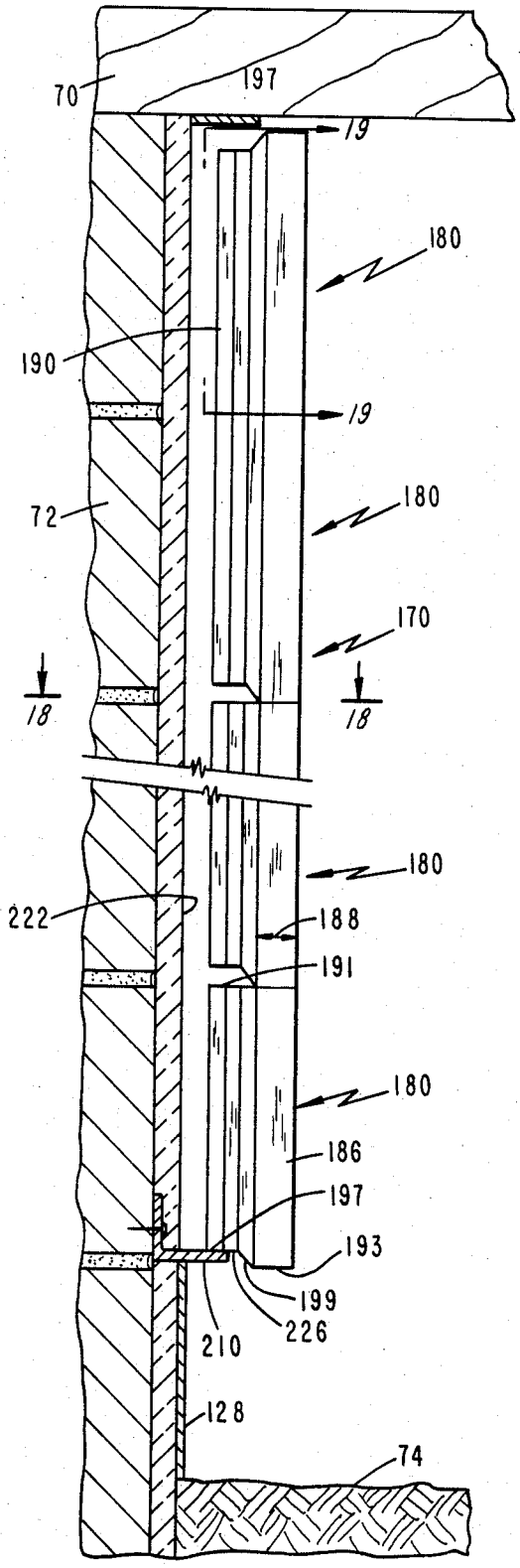
FIG. 17 is a vertical partly side elevation, partly cross-sectional view (taken along line 7—7 in FIG. 18) showing another preferred embodiment of the present inventions in which a CM block veneer wall cladding comprising CM blocks is mounted on a side of a building substrate wall of any kind.
Figure 18:
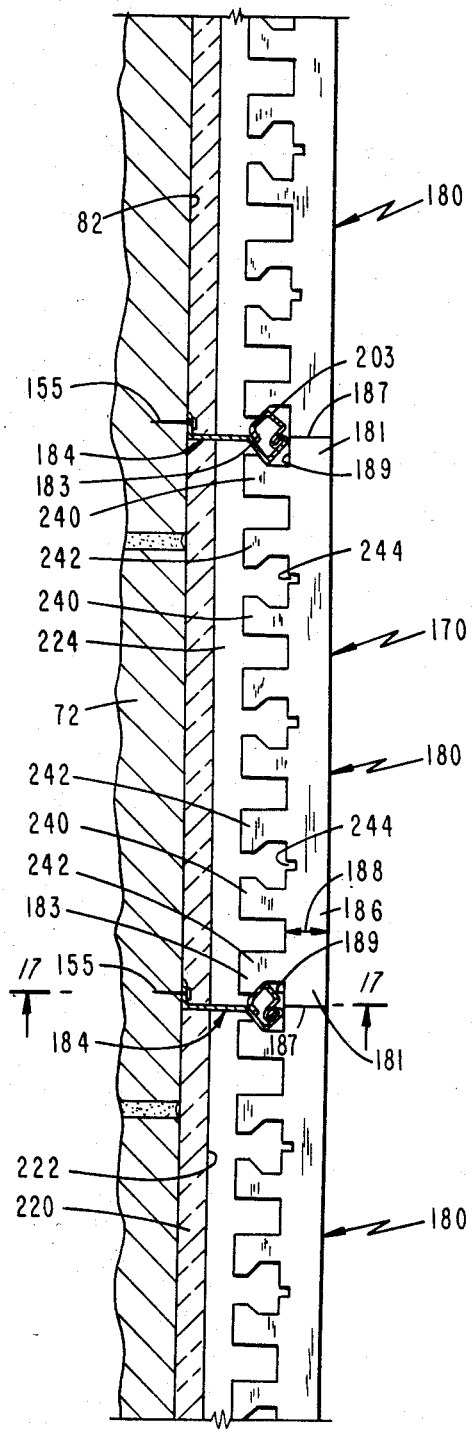
FIG. 18 is a partly sectional, partly plan view of the CM block veneer wall cladding shown in FIG. 17 taken along line 18—18 in FIG. 17, and showing a plan view of a suitable configuration of the CM veneer blocks which also can be cut to different non-modular lengths in the field.
Figure 24:
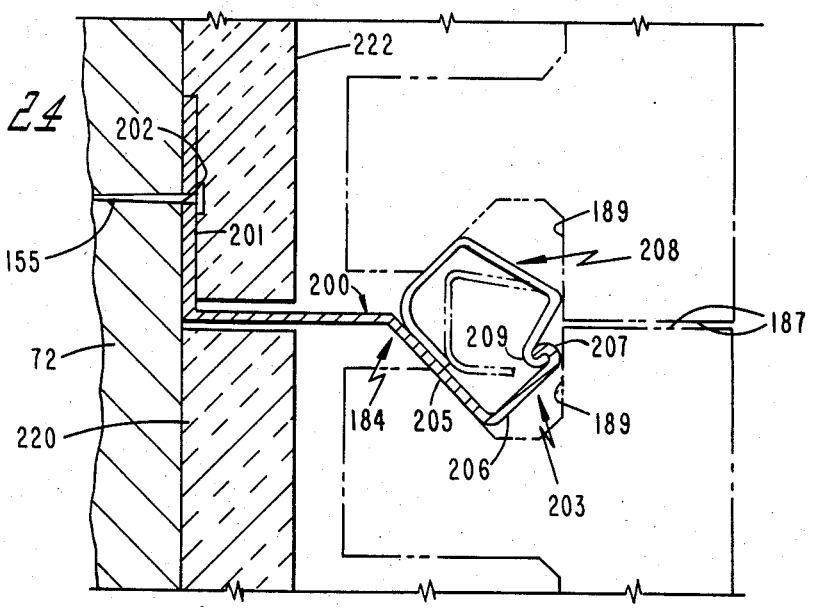
FIG. 24 is a fragmentary partly sectional and partly plan view taken along line 18—18 in FIG. 17 showing a metal block retainer batten for mounting concrete masonry veneer blocks to construct a CM veneer wall cladding such as shown in FIGS. 17–18 as explained below.

Reference is now made particularly to FIGS. 17, 18 and 24 for the following description of modified and preferred embodiments of a concrete masonry block veneer wall cladding made from CM veneer blocks and components thereof according to the present invention. In FIGS. 17 and 18 there is shown such a section of substrate wall 72 with CM veneer block cladding generally indicated at 170 mounted on substrate wall 72 (which is shown in FIGS. 17 and 18 as made up of conventional concrete masonry blocks). The substrate wall 72 extends vertically above grade 74, and the top of the substrate wall 72 may in turn support rafters 76.

Figure 19:
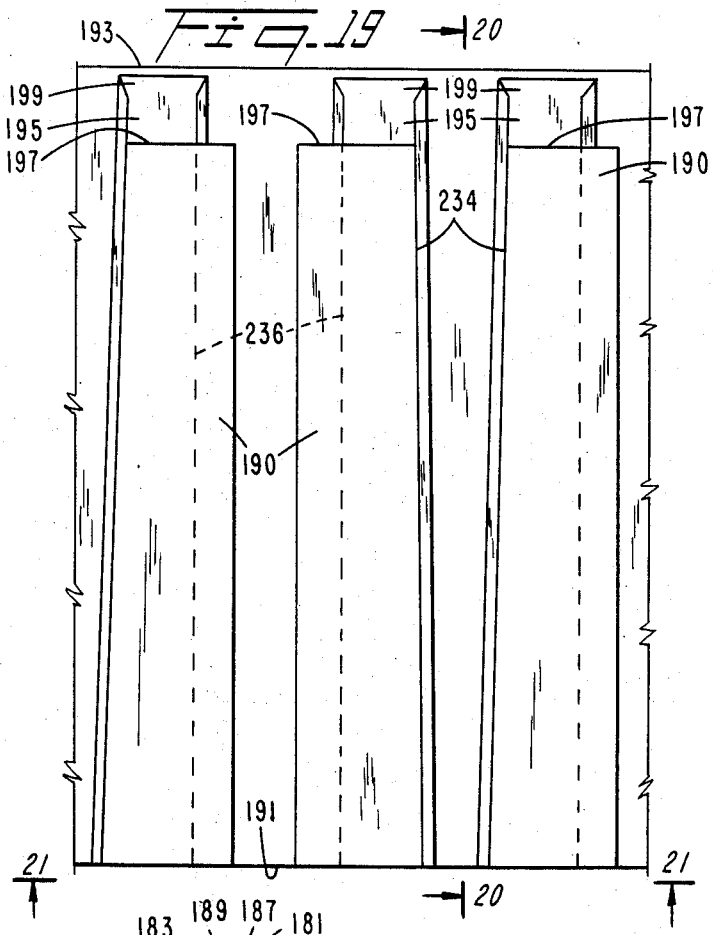
FIG. 19 is a rear elevation view of part of one of the CM veneer blocks shown in FIGS. 17 and 18, looking along line 19—19 in FIG. 17. (It is noted that the CM blocks below the top block of FIG. 17 are vertically inverted as compared to the part of such CM block shown in FIGS. 19–20.)
Figure 20:
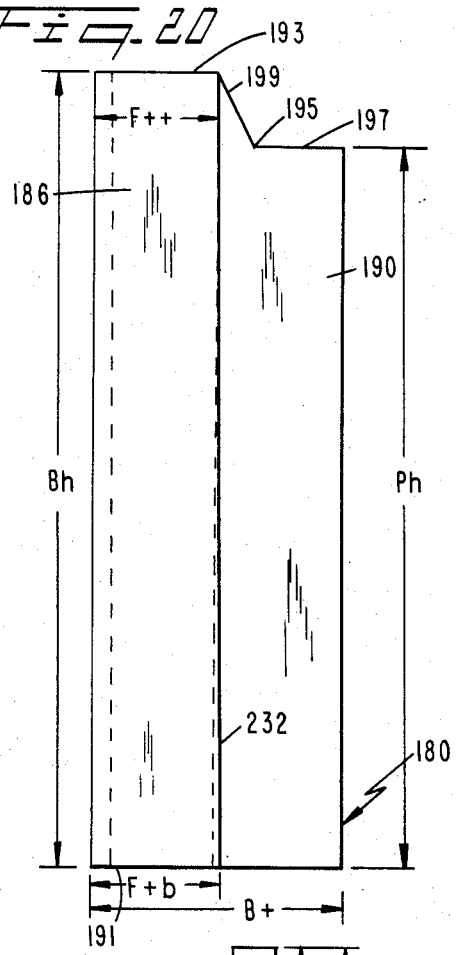
FIG. 20 is a sectional view of such CM veneer block shown in FIGS. 17–19, taken along line 20—20 in FIG. 19.

Concrete masonry veneer blocks generally indicated by arrow 180 in FIGS. 17 and 18 are mounted on the exterior surface 82 of building substrate wall 72 by means of a plurality of vertically extending battens 184 which are secured to the outside of substrate wall 72 by any suitable fastening means such as nails 155. The configuration of CM veneer blocks 180 used in the concrete masonry block veneer wall construction 170 will be apparent from the drawings of FIGS. 17–20 and the description thereof herein. The CM veneer blocks indicated generally at 180 have a substantially rectangular shape in front elevation as will be apparent from FIGS. 17–20. As especially shown in FIGS. 17–18 and 19–20, the CM veneer blocks 180 have a front face section 186 which extends along the horizontal length of the block and is of substantially uniform thickness along the length of the block as indicated at 188 in FIGS. 17 and 18 (subject to variation explained in detailed description of FIGS. 19–20 below). The CM veneer block 180 includes a plurality of rearwardly projecting members such as indicated at 190 in FIGS. 18–20 (such rearward projections 190 have a configuration as explained in detailed description of FIGS. 18–20 below). Referring now especially to FIGS. 19 and 20, each rearward projection 190 extends from one edge surface 191 of CM block 180 towards the opposite edge surface 193 of block 180, but each rearward projection 190 stops short of and is spaced from edge surface 193 forming a stepped portion 195 bounded by surfaces 197 and 199 as shown particularly in FIGS. 20 and 17 (which is described in further detail below). In the embodiment shown in FIGS. 17–18, each top tier block 180 is installed with edge surface 193 and stepped portion 195 disposed upward as shown in FIGS. 17, 18 and 19; whereas in the lower tiers of CM blocks, as shown in FIG. 17, the blocks 180 are vertically inverted so that block edge surface 193 and stepped portion 195 of projections 190 are disposed downward. Referring particularly to FIG. 18, each block 180 has at opposite ends thereof adjacent end rear projections 190 a pair of vertically extending flanges 181 and 183 which form end dovetail grooves 189 vertically extending behind the block's front facing section 186 (see FIGS. 17–20). Each of dovetail grooves 189 at each block end is adapted to receive a vertically extending block retaining means which is part of one of a pair of block retainer battens 184, as shown in FIGS. 17–18 and 24 and further explained below.

Reference is now made especially to FIG. 24 which shows in detail the cross-section of block retainer batten 184 shown in FIG. 18. FIG. 24 discloses a preferred embodiment of block retainer batten 184 which is made of metal suitable for the purpose and comprises a base portion 200 which includes an elongated L-shaped wall mounting section having one side 201 which has a series of longitudinally spaced apertures 202 for securing batten 184 to substrate wall 72 by nails 155 or other suitable fasteners. The other side 204 of said base portion 200 of batten 184 has extending integrally therefrom a CM block retainer means generally indicated at 203 which includes a generally L-shaped end portion 205, 206 with a U-shaped edge portion 207 having a cross-sectional configuration as shown in FIG. 24. A spring clip member 208 having a cross-sectional configuration as shown in FIG. 24, including a U-shaped edge portion 209, is secured to the U-shaped edge portion 207 of block retainer means 203 of batten 184 by pressfit, welding or other suitable means. Spring clip member 208 is made of lighter or more flexible metal than batten base section 200, whereby spring clip member 208 may flex with respect to other parts of batten 184 as illustrated in broken line in FIG. 24. The block retainer batten 184 is made of any suitable length so that a plurality of block retainer battens 184 can be mounted vertically at horizontally spaced intervals on substrate wall 72 with battens 184 extending a sufficient vertical distance so that a series of CM veneer blocks 180 can be mounted on the battens 184 to form a veneer block wall cladding 170 in a manner which will be apparent from FIGS. 17–18 and 24 and the description herein. The batten 184 is flexible whereby spring clip 208 and block retainer means 203 may flex so as to pass inner end flanges 183 of a CM block 180 and then block retainer means 203 is received and locked in end dovetail grooves 189 of two adjacent CM blocks 180 with the end surfaces 187 of said blocks 180 adjacent to each other, as shown in FIGS. 18 and 24.

Referring particularly to FIG. 17, an angle or other structural steel shape 210 (or equivalent support means) is anchored to the substrate wall 72 by nails or other suitable fastener means to support the weight of the CM veneer block wall cladding 170 formed by CM veneer blocks 180 stacked verticallly on top of each other as shown particularly in FIG. 17. Since the battens 184 are secured to the substrate wall 72, the block retainer means 203 of battens 184 extending into dovetail grooves 189 at opposite ends of the CM veneer blocks 180 serve to hold the blocks 180 against horizontal force sideways and outward from substrate wall 72. Thus, battens 184 retain blocks 180 on the substrate wall 72 in conjunction with the vertical support member 210 so as to form CM veneer block wall cladding 170 on substrate wall 72. The number of CM veneer blocks 180 which could be mounted in a given vertical course of CM blocks depends on the weight of the CM veneer blocks 180 and in turn on the CM block size and density of the concrete masonry mixture of the blocks as related to the load-bearing capacity of support members 210. In general, with present CM block technology and industrial practice further discussed below, block retainer battens such as shown at 184 may be made of a length sufficient for extending vertically up to about 12 feet for most commercial installations.

In assembling the CM veneer blocks 180 to the existing substrate wall 72, the lowermost block 180 of each vertical set of blocks is installed on a pair of adjacent vertically extending battens 184 with the surface 197 at the bottom of the rearwardly extending portions 190 of lowermost blocks 180 resting on the angle 210 (or like support means). Each vertical set of blocks 180 is assembled by successively stacking blocks 180 on top of each other and locking each block 180 between the two adjacent laterally spaced battens 184 by flexing and inserting the block retainer means 203 into, and causing them to lock in, dovetail grooves 189 at each of the opposite ends of each CM block 180. The various courses of CM veneer blocks 180 are assembled in such manner to construct CM veneer block cladding 170 working upward to the course of blocks just below the top course of CM blocks 180. As shown in FIG. 17, the top CM blocks 180 of the top course is shown installed vertically inverted with the surface 197 of rearwardly extending portion 190 disposed up, rather than downward like for bottom CM block 180 on support member 210 and other CM blocks below the top course CM block. It is noted, however, that, when using block retainer battens 184 such as disclosed in FIGS. 24 and 18 (or other alternative battens described below), each of top CM blocks 180 may be installed with the surface 197 of rear projection 190 disposed vertically downward the same as the blocks 180 below. However, even using battens 184 such as shown in FIGS. 2 and 18 (or said other battens below-discussed), structural impediments at or below the building rafters may make it necessary or desirable to install the top veneer blocks inverted as shown in FIG. 17.

The lower and upper edge surfaces 191 and 193 of the CM veneer blocks 180 will abut closely against the adjacent upper or lower surfaces of the next adjoining CM block(s), as the case may be. Also, vertical side end surfaces 187 on the front facing flanges 181 of the CM veneer blocks 180 will be adjacent to, or abut against, the like side end surfaces 187 of adjoining CM blocks 180 as shown in FIGS. 18 and 24. In constructing a CM veneer block wall cladding 170 according to FIGS. 17, 18 and 24, the CM veneer blocks 180 may be dry stacked or the upper, lower and side joints between such blocks 180 may be adhered together.

In the building construction industry, the term "concrete masonry block" (also herein called "CM block") refers to a block made with a concrete cementitious material averaging about 100 lbs/cu.ft. density or more and made of such a size and weight (about 15–21 lbs.) so that the CM block can be handled at the construction site by a single mason or laborer for use in construction of a CM block substrate wall like 72, and also for making a CM block veneer wall cladding 170 according to embodiments of FIGS. 17–18, 17A and 19–30 (or a CM block veneer wall cladding according to embodiments of FIGS. 1–2 plus 3–16). Further, in commercial practice a concrete masonry block must be makeable in a conventional commercially available CM block casting machine with a suitably modified mold using modified core and other mold components. Further, to be commercially competitive, CM blocks must be made in such equipment at the rate of one CM block every 5–6 seconds (or preferably faster). It is noted that from technical, practical and commercial viewpoints, CM blocks are different in kind from precast concrete panels or slabs used in the construction industry with respect to various factors such as size, method of manufacture, curing time, manner of installation, etc.

Using good current practice, the CM veneer blocks 180 (and other CM veneer blocks shown in the drawings hereof and described herein) would be made with such concrete cementitious material according to the foregoing with various components of said CM veneer blocks being configured and sized to achieve characteristics herein discussed while also making it possible to meet other requirements with respect to commercial production, strength, weight, convenience of use in the field, etc. With presently available materials and according to present practice, the CM veneer block 180 (or variations thereof disclosed in FIGS. 21–23 and 30–34) would incorporate features now particularly discussed with special reference to FIGS. 19–20 and 17–18.

CM veneer blocks 180 made in the U.S.A. will be based on a basic 4-inch module and generally 24-inch block length (or will be based on a comparable metric modular length of 60 cm in metric system countries). Also CM veneer blocks 180 may be made of different lengths besides 24 inches with configurations as discussed below with reference to FIGS. 18 and 21–23, whereby such CM veneer blocks may be conveniently cut by workmen in the field to one of the number of different lengths for wall sections of varying dimensions not conforming to established modular size (analogously to discussion above with respect to the CM veneer blocks of FIGS. 1–5). Reference is now made especially to FIGS. 19–20. FIG. 19 shows part of a CM veneer block 180 with edge surface 191 being disposed downwardly (whereby surface 191 constitutes the bottom plan configuration of CM block 180) and with block edge surface 193 and corner 195 at the end of rear projections 190 being disposed upwardly in FIG. 19; see likewise in FIG. 20 which is a cross-section view of CM veneer block 180 along line 20–20 in FIG. 19. The CM veneer blocks 180 (and variations thereof shown in FIGS. 18, 20–23 and 30–34 below discussed) are molded with edge surface 191 disposed at the bottom of the CM block casting mold and edge surface 193 disposed at the top of the CM block casting mold using a conventional CM block casting machine with modified mold and core components. The overall height of block 180 (which is the distance between surfaces 191 and 193 indicated by "Bh") would typically be 8 inches, but block height "Bh" could be 6 inches or 4 inches. The length or height of rear projections 190 (i.e., the distance between block surface 191 and the top surface 197 of projections 190 indicated by "Ph") is about 90% of block height, plus about 1% of block height or minus about 1% of block height. That is, the length "Ph" of projections 190 will be about 89% to 91% of the height "Bh" of block 180. The CM veneer block 180 would have an overall thickness indicated at "Bt" of about 2-⅝inches. The edge 197 of rear projections 190 extends inward toward block front face portion 186 only part of the depth of said projections 190 as shown particularly in FIG. 20, and said projection edge is connected at corner 195 to block edge surface 193 by a segment having a sloping surface 199 extending between surfaces 197 and 193 at an angle of about 30° with respect to vertical (i.e., sloping surface 199 is disposed at an angle of about 60° to surfaces 193 and 197 of CM veneer block 180). The described relationship of the height of projections 190 ("Ph") to overall CM veneer block height ("Bh") and the above-described configuration between the end of projections 190 at sloping corner 195 adjacent CM block edge surface 193 will achieve better and more consistent molding of CM veneer blocks 180 made in a conventional CM block casting machine with suitably modified molds and core parts, etc. The CM block face portion 188 has a thickness indicated at "Ftb" at bottom plan edge surface 191 and a smaller thickness "Ftt" at opposite block edge surface 193 thereby providing an inner surface 232 disposed at a small angle to vertical of about 9°; such angle helps break the vacuum just after the CM veneer block is molded in a CM block casting machine and thereby facilitates removal of the CM block 180 from the mold with said block moving in vertical direction downward. Side surfaces 234 and 236 of rear projections 190 are also disposed at a small angle to vertical of about 9° for like reasons as said surface 232 to facilitate removal of the CM block 180 from the block making machine. For a commercial CM veneer block 180 having an overall thickness "Bt" of 2.625 inches: the face portion 186 will have a thickness "Ftb" of about 1.375 inches at block edge surface 191, and a thickness "Ftt" of about 1.25 inches at block edge surface 193; and the overall depth or thickness of rear projections 190 will be about 1.25 inches adjacent bottom plan edge surface 191 and about 1.375 inches adjacent opposite edge surface 193.

Reference is made again particularly to FIGS. 17–18 plus 24 for discussion of additional features of a CM veneer block wall cladding 170 and installation thereof according to this embodiment. Layers of insulation generally indicated at 220 are preferably applied to the outer surface of building exterior wall substrate 72 between adjacent battens 184 (or between alternative type battens shown in FIGS. 25–29 and below discussed). Insulation 220 may be suitable conventional insulation known in the art and it may be secured to substrate 72 by any known suitable means. The insulation 220 is preferably also provided with a reflective surface indicated at 222 which is conventional the art. There is preferably a slight vertically extending spacing between the adjacent ends 187 of adjacent CM blocks 180 mounted on substrate wall 72. The battens 184 (or alternate type battens of below-discussed FIGS. 25–29) are so dimensioned and the components of CM veneer blocks 180 are so dimensioned that when the CM veneer blocks 180 are mounted on the building exterior wall substrate 72, there is an air gap or space generally indicated at 224 between the back surfaces of the CM veneer blocks 180 and substrate wall 72 and also the insulation 220 when such insulation is used. The air space 224 also permits drainage of any water which may condense behind the CM veneer block wall cladding 170 formed by the CM blocks 180; and openings indicated at 226 are provided at the bottom of the CM veneer block wall cladding 170 with clearance between the inner portions of the CM veneer block wall cladding 170 and the support angle 210 thereby permitting condensed moisture to drain to grade indicated at 74 in FIG. 17. Still referring to FIG. 17, the angle 210 anchored to the substrate wall 72 to provide means supporting the CM veneer block wall 70 is preferably located above grade level 74 for drainage of condensed water and sometimes for other reasons. A protective coating 128 is applied to building exterior wall 72 over part of insulation 220; coating 128 preferably is waterproof and sometimes otherwise treated for various protective purposes.

Figures 17A, 30:
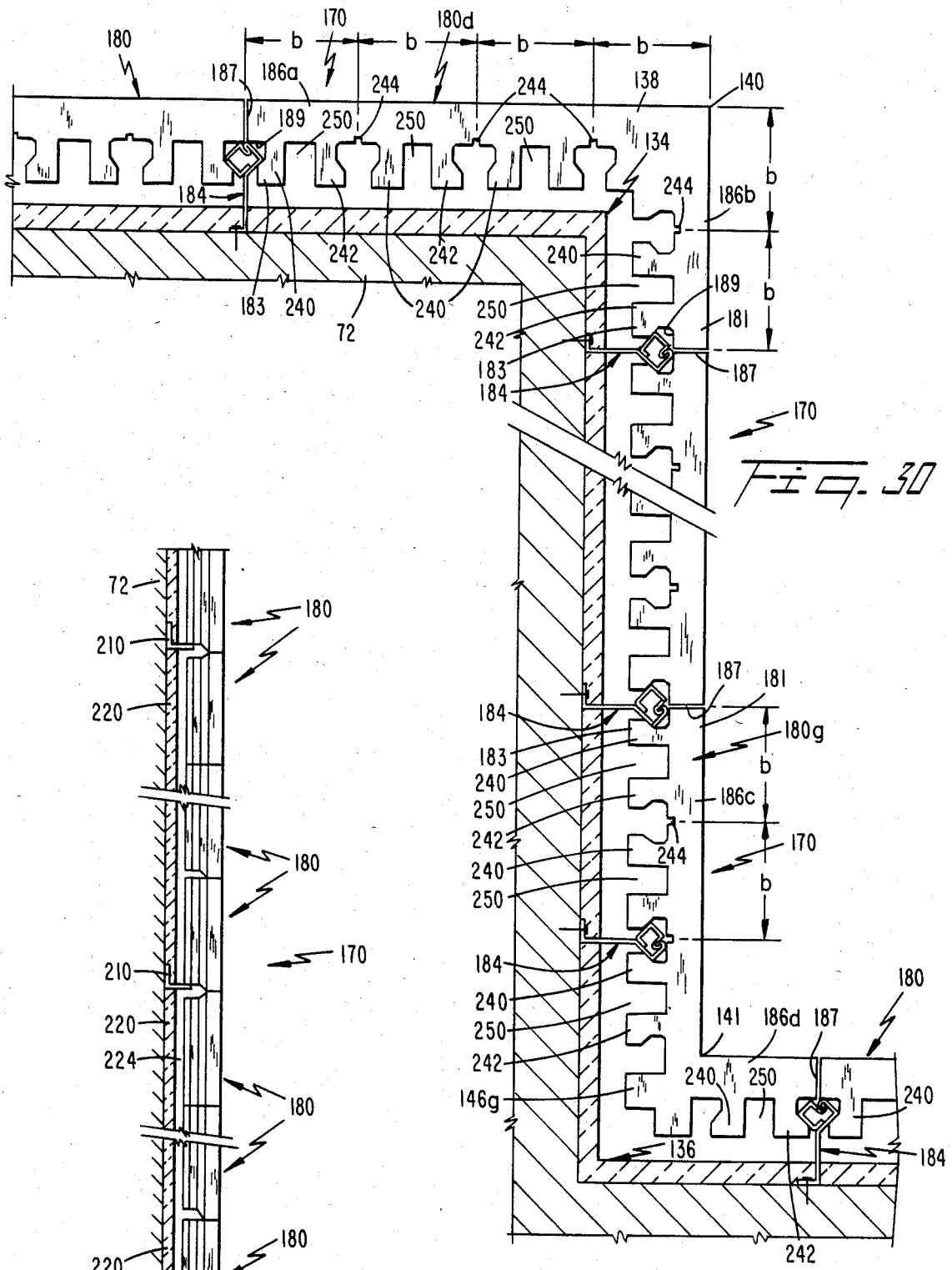
FIG. 17A is a vertical partly side elevation, partly sectional view similar to FIG. 17 illustrating a CM veneer block wall cladding comprising CM blocks installed on a substrate wall of a high-rise building.
FIG. 30 is a partly sectional and partly plan view of corners of a building incorporating a concrete masonry veneer block wall cladding construction such as shown in FIGS. 17 and 18, with FIG. 30 showing modified CM veneer blocks for use respectively on outside and inside corners at the junction of two such walls.

Referring now especially to FIG. 17A, the CM veneer block wall cladding 170 disclosed herein can be used to build CM veneer block walls on the exterior walls of a high-rise building as well as a low-rise house. As shown in FIG. 17A, in a high-rise building, a plurality of supports like angles 210 (or equivalent means) are anchored to the substrate wall 72 at vertically spaced intervals and extending horizontally along each wall to sustain the weight of a section of the CM veneer block wall cladding 170 formed by the blocks supported by each such horizontal support means, i.e., angles 210. In general, with presently available materials and present state of the art, such support means like angles 210 will support a column of CM veneer blocks 180 about 12 ft. high. Thus, the vertical extent of CM wall cladding section 170 between each of such horizontal means like angles 210 would be about 12 ft. or less and would accommodate a suitable number of courses of CM veneer blocks 180 (or other CM veneer blocks shown in FIGS. 17–18, 21–23 and 30–34 and also in FIGS. 1–5 and 10–16) according to the height of such CM blocks, which is determined in light of factors discussed herein. It is noted that the materials usable for making such CM veneer blocks, and the dimensions thereof, and the number of courses which can be stacked on a given set of such horizontal support means like angles 210 (or like 100 and/or 102) may vary depending on future developments in the art.

Figure 25:
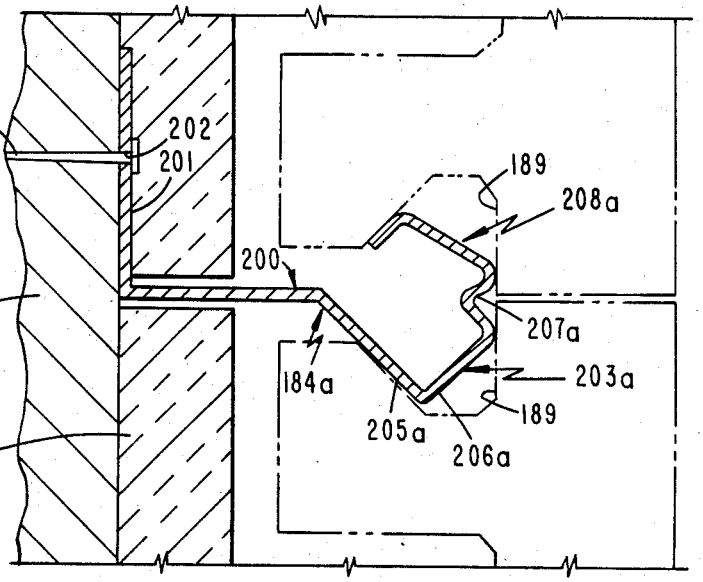
FIG. 25 is a fragmentary partly sectional and partly plan view similar to FIG. 24 but showing a second alternative embodiment of metal block retainer batten for mounting the CM veneer blocks as described below.

Reference is now made to FIG. 25 which discloses in detail another embodiment of block retainer metal batten usable in a manner analogous to the batten 184 of FIG. 24 for constructing a CM veneer block wall cladding 170 as discussed with reference to FIGS. 17, 18 and 24. The block retainer batten embodiment shown in FIG. 25 is generally indicated at **184*a*; portions of batten 184*a* in FIG. 25 which are the same as batten 184 in FIGS. 24 and 18 are identified with like numerals, whereas portions of the batten 184*a* in FIG. 25 which are analogous to, or a close variation of, portions of the batten 184 of FIG. 24 are identified by like numerals plus a different subscript letter. Block retainer batten 184*a* is made of metal suitable for the purpose and comprises a base portion 200 which includes an elongated L-shaped wall mounting section having one side 201 which has a series of longitudinally spaced apertures 202 for securing batten 184*a* to substrate wall 72 by nails 155 or other suitable fasteners. The other side 204 of said base portion 200 of batten 184*a* has extending integrally therefrom a CM block retainer means generally indicated at 203*a* which includes a generally L-shaped end portion 205*a*, 206*a* with a V-shaped intermediate section 207*a* integrally connected to a spring clip portion 208*a* having a cross-sectional configuration as shown in FIG. 25. Spring clip portion 208*a* is preferably resilient so that it may flex with respect to other parts of batten 184*a* as illustrated in broken line in FIG. 25. The block retainer batten 184*a* is made of any suitable length so that a plurality of block retainer battens 184*a* can be vertically mounted at horizontally spaced intervals on substrate wall 72 with battens 184*a* extending a sufficient vertical distance so that a series of CM veneer blocks 180 can be mounted on the battens 184*a* to form a veneer block wall cladding 170 in a manner analogous to the assembly of the CM veneer blocks 180 using metal battens 184 as described above with reference to FIGS. 17, 18 and 24. The batten 184*a* is flexible whereby spring clip portion 208*a* and end portion 203*a* may pass inner end flanges 183 of a CM block 180 and the CM block retainer means 203*a* is received and locked in end dovetail grooves 189 of two adjacent CM blocks 180 with the end surfaces 187 of said blocks 180 being adjacent to each other, as shown in FIGS. 18 and 25. The above discussion of construction of a CM veneer block wall cladding 170 with reference to FIGS. 17, 18 and 24 using the batten of FIG. 24 is applicable to building a CM veneer block wall cladding 170 using the batten 184*a*of FIG. 25** and thus will not be repeated here.

Figure 26:
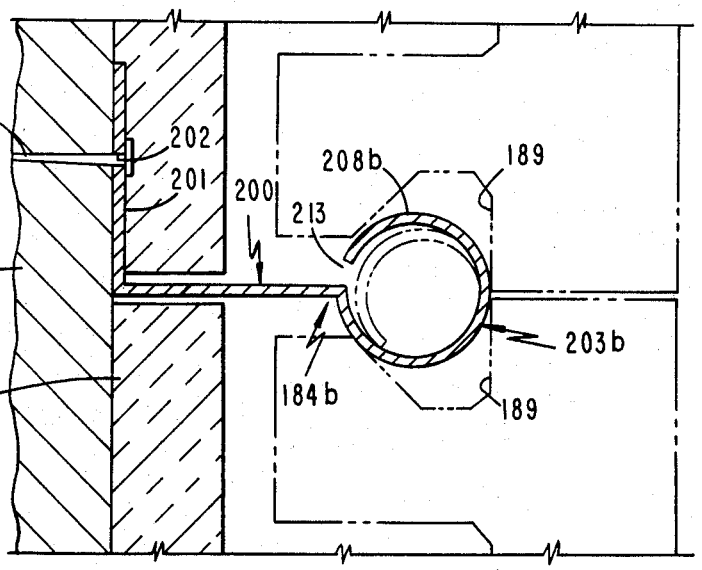
FIG. 26 is a fragmentary partly sectional and partly plan view similar to FIGS. 24 and 25 but showing a third alternative metal block retainer batten for mounting the CM veneer blocks as described below.

Reference is now made to FIG. 26 which discloses in detail a third embodiment of block retainer metal batten usable in a manner analogous to the respective battens 184 and **184*a* of FIGS. 24 and 25 for constructing a CM veneer block wall cladding 170 as discussed with reference to FIGS. 17, 18 and 24 plus 25. The block retainer batten embodiment shown in FIG. 26 is generally indicated at 184*b*; portions of batten 184*b* in FIG. 26 which are the same as in batten 184 in FIGS. 24 and 18 are identified with like numerals, whereas portions of the batten 184*a* in FIG. 25 which are analogous to, or a variation of, portions of batten 184 of FIG. 24** are identified by like numerals plus a different subscript letter.

Block retainer batten 184*b* is made of metal suitable for the purpose and comprises a base portion 200 which includes an elongated L-shaped wall mounting section having one side 201 which has a series of longitudinally spaced apertures 202 for securing batten 184*b* to substrate wall 72 by nails 155 or other suitable fasteners. The other side 204 of said L-shaped section of batten 184b has extending integrally therefrom a CM block retainer means generally indicated at 203*b* which includes a substantially circular-shaped end portion 208*b* having a cross-sectional configuration as shown in FIG. 26. Circular end portion 208*b*is preferably resilient and has its end spaced at 213 from base portion 200 so that circular portion 208*b* may flex with respect to other parts of batten 184*b* as illustrated in broken line in FIG. 26. The block retainer batten 184*b* is made of any suitable length so that a plurality of block retainer battens 184*b* can be vertically mounted at horizontally spaced intervals on substrate wall 72 with battens 184*b* extending a sufficient vertical distance so that a series of CM veneer blocks 180 can be mounted on the battens 184*b* to form a veneer block wall cladding 170 in a manner analogous to the assembly of the CM veneer blocks 180 using the metal battens 184 or 184*a* as described above with reference to FIGS. 17, 18 and 24 and also FIGS. 17–18 plus 25. The CM block retainer means 203*b* of battens 184*b* is received and locked in end dovetail grooves 189 of two adjacent CM blocks 180 with the end surfaces 187 of said blocks 180 adjacent to each other, as shown in FIGS. 18 and 26. The above discussion of construction of a CM veneer block wall cladding 170 with reference to FIGS. 17, 18 and 24 plus FIG. 25 using the batten of FIG. 24 or of FIG. 25 is applicable to building a CM veneer block wall cladding 170 using the batten 184*b* of FIG. 26 and thus will not be repeated here.

Figure 27:
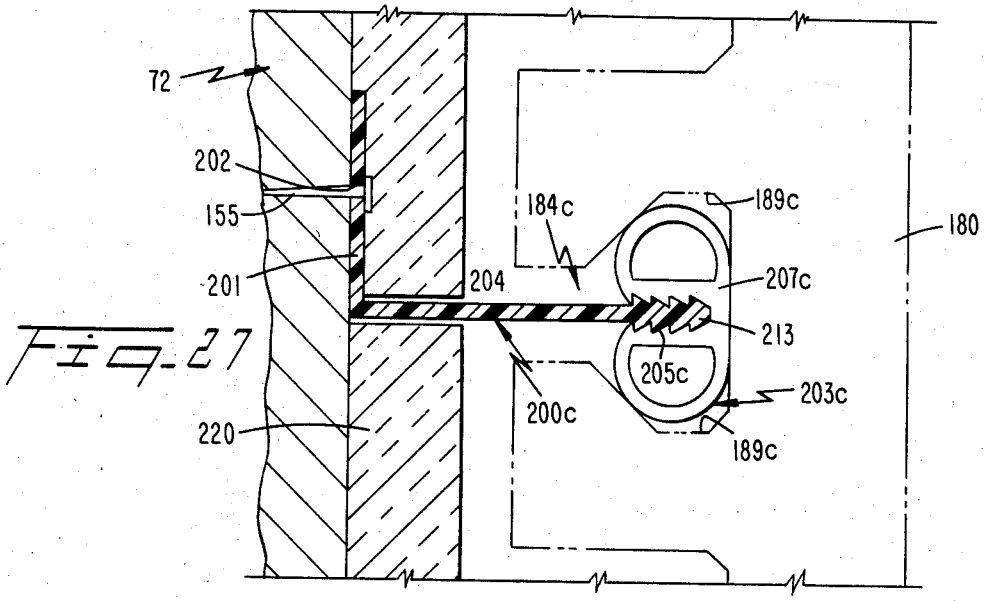
FIG. 27 is a fragmentary partly sectional and partly plan view similar to FIGS. 24–26 but showing a plastic block retainer batten for mounting the CM veneer blocks to construct a veneer wall cladding according to FIGS. 17–18 as discussed below.

Reference is now made to FIG. 27 which discloses in detail still another embodiment of block retainer plastic batten usable in a manner analogous to the battens 184, 184*a* and 184*b* of FIGS. 24–26 for constructing a CM veneer block wall cladding 170 as discussed with reference to FIGS. 17, 18 and 24 plus FIGS. 25–26. The block retainer batten embodiment shown in FIG. 27 is generally indicated at 184*c*; portions of batten 184*c* in FIG. 27 which are the same as in batten 184 in FIGS. 24 and 18 are identified with like numerals, whereas portions of the batten 184*c* in FIG. 27 which are analogous to, or a variation of, portions of the batten 184 of FIG. 24 are identified by like numerals plus a different subscript letter. Block retainer batten 184*c* is made of plastic material suitable for the purpose and comprises a base portion 200*c* which includes an elongated L-shaped wall mounting section having one side 201 which has a series of longitudinally spaced apertures 202 for securing batten 184*c* to substrate wall 72 by nails 155 or other suitable fasteners. The other side 204 of said L-shaped section of batten base portion 200*c* has extending integrally therefrom part of a two-part CM block retainer means generally indicated at 203*c* which includes on leg 204 an end portion 205*c* having one-way serrations or ratchet teeth on opposite sides thereof as shown in FIG. 27. Plastic inserts 207*c* having a plan (and cross-sectional) configuration as shown in FIG. 27 are pre-installed in a pair of adjacent dovetail recesses indicated at 189*c* in the CM veneer blocks 180 shown in FIG. 27 (adjacent recesses 189*c* in this embodiment are not at the end of blocks 180 like end dovetail recesses 189). The plastic inserts 207*c* may be held in said recesses 189*c* of the CM veneer blocks by press-fit or friction, or with adhesive if necessary or desirable. Each plastic insert 207*c* has a longitudinally extending recess 213 which has one-way serrations or ratchet teeth for engaging the ratchet teeth on said end portion 205*c* of batten 184*c* as shown in FIG. 27. The plastic of said batten base portion 200*c* and the plastic of said CM block inserts 207*c* would be made of dual durometer (measure of hardness) so that the plastic of one part would be hard enough to snap into and lock with the plastic of the other part which would be resilient enough to allow insertion. In constructing a CM veneer block wall cladding 170 using the battens 184*c* according to FIG. 27, the batten base portions 200*c* would be vertically secured at suitably spaced intervals to the building exterior substrate wall 72, and the CM veneer blocks 180 including inserts 207*c* would be pressed towards substrate wall 72 on to the base portions 200*c* of two adjacent battens 184*c* so as to thereby hold the CM blocks in place. The base portion 200*c* of block retainer batten 184*c* is made of any suitable length so that a plurality of such base portions 200*c* for block retainer battens 184*c* can be vertically mounted at horizontally spaced intervals on substrate wall 72 and extending a sufficient vertical distance so that a series of CM veneer blocks 180 can be mounted by means of battens 184*c* to form a veneer block wall cladding 170 in a modified manner analogous to the assembly of the CM veneer blocks 180 using the metal battens 184 or 184*a* or 184*b* as described above with reference to FIGS. 17, 18 and 24 plus FIGS. 25 and 26). The above discussion of construction of a CM veneer block wall cladding 170 with reference to the Figures mentioned in the preceeding sentence is applicable to building a CM veneer block wall cladding 170 using the batten 184*c* of FIG. 27 and thus will not be repeated here.

Figure 28:
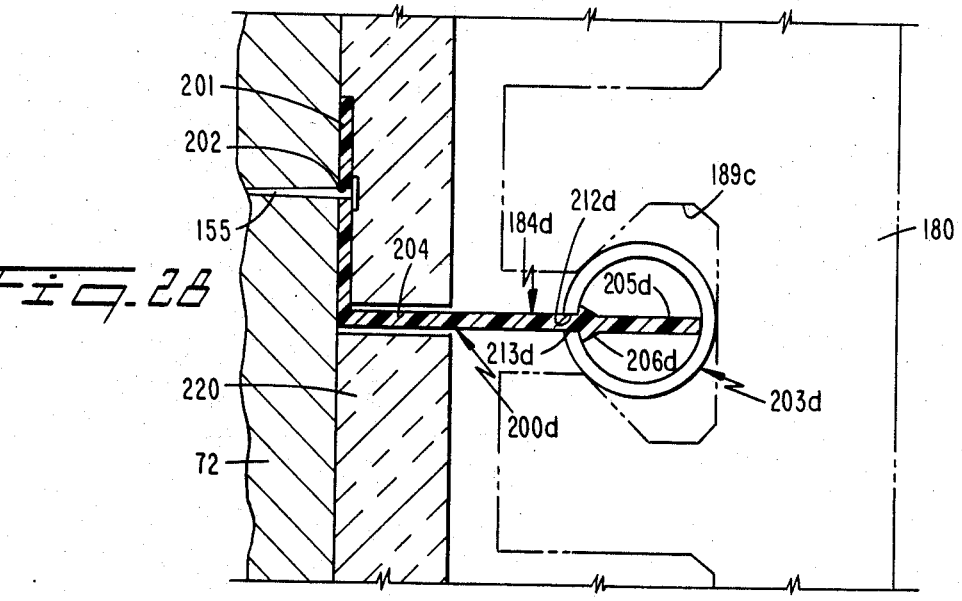
FIG. 28 is a fragmentary partly sectional and partly plan view similar to FIG. 27 showing a second alternative plastic block retainer batten for mounting the CM veneer blocks as explained below.

Reference is now made to FIG. 28 which discloses in detail still another embodiment of block retainer plastic batten usable in a manner analogous to the battens 184, 184*a*, 184*b* and 184*c of* FIGS. 24–27 for constructing a CM veneer block wall cladding 170 as discussed with reference to FIGS. 17, 18 and 24 plus FIGS. 25–27. The block retainer batten embodiment shown in FIG. 28 is generally indicated at 184*d*; portions of batten 184*d* in FIG. 28 which are the same as in batten 184 in FIGS. 24 and 18 are identified with like numerals, whereas portions of the batten 184*d* in FIG. 28 which are analogous to, or a variation of, portions of the batten 184 of FIG. 24 or batten 184*c* of FIG. 26 are identified by like numerals plus a different subscript letter. Batten 184*d* is made of plastic material suitable for the purpose and comprises a base portion 200*d* which includes an elongated L-shaped wall mounting section having one side 201 which has a series of longitudinally spaced apertures 202 for securing batten 184*d* to substrate wall 72 by nails 155 or other suitable fasteners. The other side 204 of said L-shaped section of batten base portion 200*c* has integral therewith one part of a two-part CM block retainer means generally indicated at 203*d* which includes an end portion 205*c* having one-way ridge members 206*d* on opposite sides thereof as shown in FIG. 28. Plastic insert clips 207*d* having a slotted substantially tubular plan (or cross-sectional) configuration as shown in FIG. 28 are pre-installed in a pair of adjacent dovetail recesses 189*c* in the CM veneer blocks 180 as shown in FIG. 28 (and analogously to said FIG. 27 embodiment). The plastic insert clips 207*d* may be held in said recesses 189*c* of the CM blocks by press-fit or friction, or with adhesive if necessary or desirable. Each plastic insert clip 207*d* has a longitudinally extending slot 213*d* for passing over one-way ridge members 206*d* from said end portion 205*d* to side leg 204 of batten 184*d*. The plastic of said batten base portion 200*d* and the plastic of said insert clips 207*d* would be made of suitable material and appropriately flexible so that tubular clip 207*d* readily snaps over one-way ridge members 206*d* and clamps onto leg 204 of base portion 200*d* of batten 184*d*. In constructing a CM veneer block wall cladding 170 using the battens 184*d* according to FIG. 28, the batten base portions 200*d* would be vertically secured at suitably spaced intervals to the building exterior substrate wall 72, and the CM veneer blocks 180 including inserts 207*d* would be pressed towards wall 72 on to the base portions 200*d* of two adjacent battens 184*d* so as to thereby hold the CM blocks in place. The base portion 200*d* of block retainer batten 184*d* is made of any suitable length so that a plurality of such base portions 200*d* for block retainer battens 184*d* can be vertically mounted at horizontally spaced intervals on substrate wall 72 and extending a sufficient vertical distance so that a series of CM veneer blocks 180 can be mounted by means of battens 184*d* to form a veneer block wall cladding 170 in a modified manner analogous to the assembly of the CM veneer blocks 180 using the metal battens 184 as described above with reference to FIGS. 17, 18 and 24 and in like manner as discussed with reference to FIGS. 17–18 plus 27. The above discussion of construction of a CM veneer block wall cladding 170 with reference to the Figures mentioned in the preceeding sentence is applicable to building a CM veneer block wall cladding 170 using the batten 184*d* of FIG. 28 and thus will not be repeated here.

Figure 29:
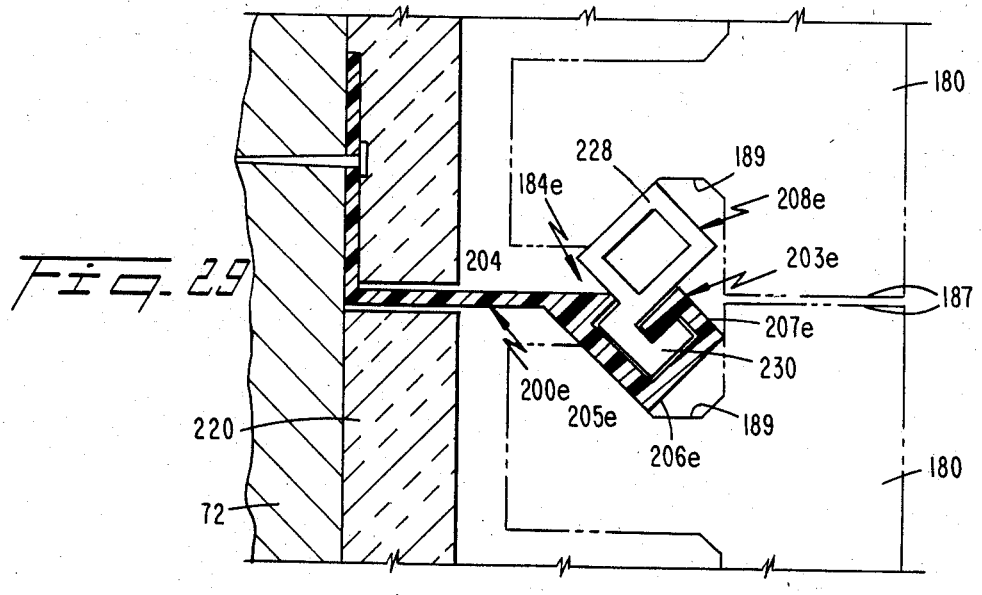
FIG. 29 is a fragmentary partly sectional and partly plan view similar to FIG. 28 but showing a third alternative type plastic block retainer batten for mounting the CM veneer blocks as described below.

Reference is now made to FIG. 29 which discloses in detail a third embodiment of plastic block retainer batten usable in a manner analogous to the batten 184 of FIG. 24 for constructing a CM veneer block wall cladding 170 as discussed with reference to FIGS. 17, 18 and 24. The plastic block retainer batten embodiment shown in FIG. 29 is generally indicated at 184*e*; portions of batten 184*e* in FIG. 29 which are the same as batten 184 in FIGS. 24 and 18 are identified with like numerals, whereas portions of the batten 184*e* in FIG. 29 which are analogous to, or a close variation of, portions of the batten 184 of FIG. 24 are identified by like numerals plus a different subscript letter. Block retainer batten 184*e* is made of plastic material suitable for the purpose and comprises a base portion 200*e* which includes an elongated L-shaped wall mounting section having one side 201 which has a series of longitudinally spaced apertures 202 for securing batten 184*e* to substrate wall 72 by nails 155 or other suitable fasteners. The other side 204 of said L-shaped section of batten 184 has extending therefrom a CM block retainer means generally indicated at 203*e* which includes a generally L-shaped end portion 205*e*, 206*e* with a U-shaped end portion 207*e* which receives to a plastic retainer clip 208*e* having a plan (or cross-sectional) configuration as shown in FIG. 29. The retainer clip 208*e* includes a rectangular portion 228 plus a U-shaped portion 230 as shown in FIG. 29. The base portion 200*e* of block retainer batten 184*e* is made of any suitable length so that a plurality of batten base portions 200*e* can be mounted vertically at horizontally spaced intervals on substrate wall 72 and extending a sufficient vertical distance whereby a series of CM veneer blocks 180 can be mounted by means of battens 184*e* to form a veneer block wall cladding 170 in a manner analogous to the assembly of the CM veneer blocks 180 using the metal battens 184 as described above with reference to FIGS. 17, 18 and 24. The base portion 200*e* of batten 184*e* is flexible whereby the end portion 203*e* thereof may pass inner end flanges 183 of a CM block 180 and be received in end dovetail grooves 189 of two adjacent CM blocks 180 with the end surfaces 187 of said blocks 180 adjacent to each other as shown in FIGS. 29 and 18. Each plastic retainer clip 208*e* has a length not greater than the height of CM block 180 (i.e., the distance "Bh"between opposite block edge surfaces 191 and 193 shown in FIGS. 19–20); and the length of said clip 208e may be approximately the height of rear projections 190 of CM blocks 180 (i.e., the distance "Ph" between surfaces 191 and 197 shown in FIGS. 19–20). After two adjacent CM blocks 180 are preliminarily assembled as illustrated in FIG. 29 and herein described, said retainer clip 208*e* is inserted from the top with rectangular portion 228 thereof secured in end groove 189 of one of the adjacent CM blocks and the U-shaped portion 230 thereof secured in U-shaped end section 207*e* of batten base portion 200*e* as shown in FIG. 29, thereby securing the two adjacent CM blocks 180 to substrate wall 72 by means of battens 184*e* per the embodiment of FIG. 29. The further discussion above of construction of a CM veneer block wall cladding 170 with reference to FIGS. 17, 18 and 24 plus FIG. 29 is applicable to building a CM veneer block wall cladding 170 using the batten 184*e* of FIG. 29 and thus will not be repeated here.

Reference is now made particularly to FIG. 18 showing a plan view of CM veneer block 180 which includes a plurality of rearwardly extending projections 190 which have a plan configuration as shown at 240 and 242 in FIG. 18 and are made as described above with reference to FIGS. 19–20. Block 180 has four similarly shaped rearward projections 240 and also four similarly shaped rearward projections 242. Projections 240 and 242 at the ends of CM block 180 provide a pair of end dovetail grooves 189 for mounting CM veneer blocks 180 on battens 184 as above described. The CM veneer block 180 is scored or notched as indicated at 244 at different lengths from ends 187. (While FIG. 18 and other Figures show notches 244, these are markings to indicate where to cut the block 180 to one of a number of different lengths varying from modular size, and the blocks 180 may be equivalently marked in a different manner.) Rearward projections 240 have a plan configuration so that when the block 180 is cut at an adjacent notch 244, there will be provided a new pair of vertically extending flanges which form a new end dovetail groove which is like original end dovetail groove 189 and extends vertically down part of the back of thus-cut CM veneer block 180. This new resultant end dovetail groove 189 is adapted to receive the block retainer portion 203 of batten 184 in like manner for an uncut CM veneer block as shown in FIG. 18 and described above with reference to FIGS. 17–18 and 24. Similarly rearward projections 242 have a plan configuration so that when the block 180 is cut at an adjacent notch 244 that will similarly provide a new pair of vertically extending flanges forming a new dovetail end groove which is like original end groove 189 and extends vertically down part of the back of thus-cut CM veneer block 180. Such resultant new end dovetail groove 189 is similarly adapted to receive the block retainer portion 203 of batten 184 as above described. Accordingly, CM block 180 which is cut at either or both such notches 244 can be installed on adjacent battens 184 spaced on a substrate wall 72 less than the original CM block length and varying from modular dimension in like manner as an uncut block 180 as discussed above with reference to FIGS. 1, 2 and 24 when using battens like 184 shown in FIG. 24. It also will be apparent to those skilled in the art that when using alternate type battens such as shown in FIGS. 25–29 described above, the thus cut CM veneer block 180 with one or two new end dovetail grooves 189 may be analogously mounted on adjacent battens in a manner apparent to those skilled in the art in light of the disclosure herein. Further, the block 180 shown in FIG. 18 can be cut in the field at any of the various notches 244 so as to provide one or two new end dovetail retaining grooves 189 with a resultant CM veneer block of any one of various different lengths (as further discussed below) for mounting such resultant CM veneer blocks on two adjacent battens vertically secured to the outside of a substrate wall 72 at corresponding non-modular distance(s).

Figure 21:
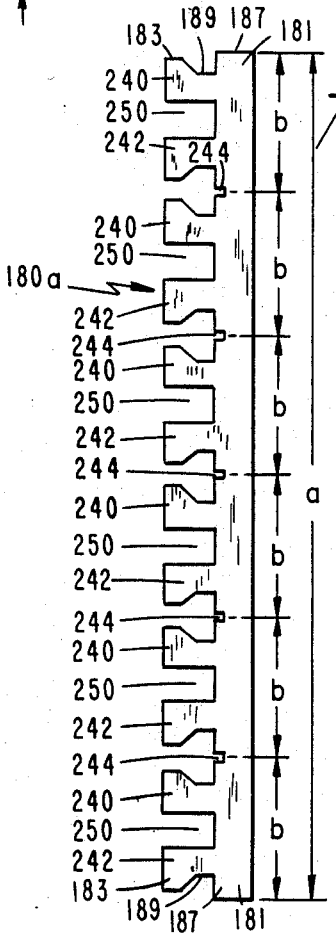
FIG. 21 is a plan view looking in the direction of line 21—21 in FIG. 19 and showing a longer version of CM veneer blocks shown in FIGS. 17 and 18 whereby the blocks can be cut by workmen in the field to provide additional different lengths to apply to a substrate wall portion which does not conform to established modular size.

Reference is now made particularly to FIG. 21 which shows a CM block generally indicated at 180*a* which is a modification of the above-described CM veneer block 180 shown in FIG. 18. Portions of the CM veneer block 180*a* in FIG. 21 which are the same as in CM veneer block 180 in FIG. 18 are identified with like numerals and/or letters. The CM veneer block 180*a* shown in FIG. 21 has six rearward projections 240 and also six rearward projections 242 with a plan configuration of block 180*a* and projections 240 and 242 as shown in FIG. 21. Notches or scores 244 are provided on the back of block 180*a* as shown in FIG. 21. The overall length of the CM veneer block 180*a* of FIG. 21 is modular dimension a. Notches 244 are spaced a distance b from the ends 187 of the block 180*a* and from each other as shown in FIG. 21. CM veneer block 180*a* shown in FIG. 21 is the same as veneer block 180 shown in FIG. 18 excepting that: veneer block 180*a* of FIG. 21 is of modular length a comprising six like sub-sections of module length b; whereas veneer block 180 shown in FIG. 18 is two-thirds modular length comprising four like subsections of module length b. When CM veneer block 180*a* is cut at any one of notches 244 that will provide new vertically extending flanges 181 and 183 which form a new dovetail end groove 189 vertically extending down part of the CM veneer block 180*a* for mounting the block on battens at the ends of the block. When block 180*a* is cut at two of notches 244 that will provide a pair of new vertically extending flanges 181 and 183 forming a pair of new end dovetail grooves 189 extending vertically down part of the CM veneer block 180*a* for mounting such new block ends on a pair of adjacent battens. Such resultant new end dovetail groove(s) 189 are each adapted to receive the block retainer means of two adjacent battens spaced at a comparable distance less than the standard modular distance. For U.S.A. usage, the configuration of CM veneer block 180*a* of FIG. 21 provides alternate cut block sections having a length of 4 inches, or 8 inches, or 12 inches, or 16 inches, or 20 inches, as well as 24 inches original length (based on length b being 4 inches and modular length a being 24 inches). Analogously, the configuration of CM veneer block 180 of FIG. 18 provides alternate cut block sections having a length of 4 inches, or 8 inches, or 12 inches, as well as 16 inches original length.

Figure 22:
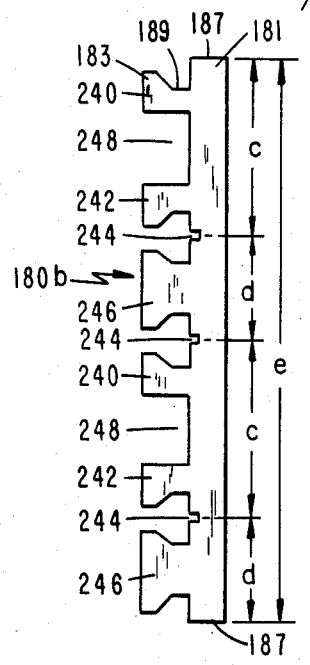
FIG. 22 is a plan view similar to FIG. 21 of still another alternate configuration of CM veneer block for use in the wall construction of FIGS. 17–18, whereby the block can be cut in the field to one of a number of different non-modular dimensions.

Reference is now made particularly to FIG. 22 showing still another plan configuration of CM veneer block generally indicated at 180*b*. Parts of the CM veneer block modification 180*b* of FIG. 22 which are the same as of CM veneer blocks 180 and 180*a* of FIGS. 18 and 21 are identified with like numerals. The CM veneer block 180*b* of FIG. 22 includes two rearward projections 240 plus two rearward projections 242 having a configuration as shown (which is like that of the projections 240 and 242 of the embodiments of FIGS. 21 and 18) plus two rearward projections 246 having a configuration as shown (which is like that of projections 94 of the CM veneer block embodiment of FIGS. 4 and 5 described above). It is noted that in the embodiment of CM block 180*b* of FIG. 22 the spacing acacing 248 between adjacent rearward projections 240 and 242 is greater than the spacing 250 between adjacent like configured rearward projections 240 and 242 in the embodiment of CM block 180*a* of FIG. 22 (and likewise regarding CM block 180 of FIG. 18). Notches or scores 244 are provided to mark where block 180*b* may be cut to provide different non-modular length CM blocks. Said notches 244 are spaced distances c and d from block ends 187 and from the next adjacent notch 244 as shown in FIG. 22.

In this embodiment of FIG. 22, dimension c as 5 inches and dimension d is 3 inches, whereby the overall length e of CM block 180*b* is 16 inches. The CM veneer block 180*b* may be cut at one of the various notches 244 to yield non-standard lengths of: 5 inches, or 3 inches, or 8 inches, or 11 inches, or 13 inches, as well as 16 inches original length. Depending at which notch(es) 244 the CM veneer block 180*b* is cut, there will be provided one or two new end flanges 181 and 183 forming one or two new end dovetail grooves 189 which extend vertically down part of the back of the thus cut CM veneer block 180*b*. Each such new end dovetail groove 189 is adapted to receive the block retainer means of a batten affixed to the substrate wall 72 as above discussed. The CM block 180*b* cut to one of different lengths can thus be installed on two adjacent battens spaced a corresponding distance, in a manner as above described with reference to the CM block embodiments 180 and 180*a* in FIGS. 21 plus 17–18.

Figure 23:
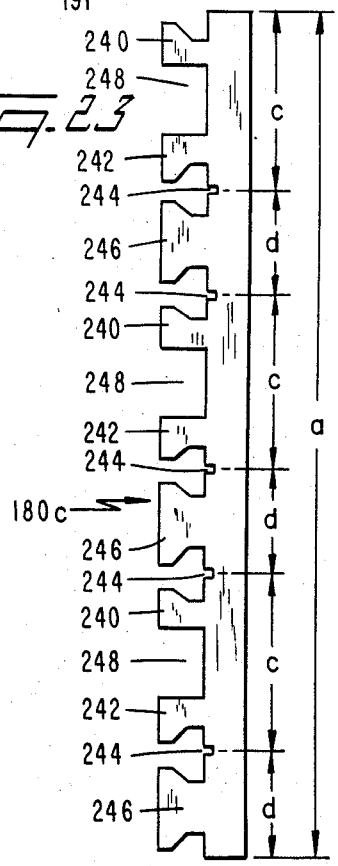
FIG. 23 is a plan view similar to FIG. 21 of yet another configuration of CM veneer block which may be cut in the field to different non-modular dimensions.

Reference is now made particularly to FIG. 23 showing still another plan configuration of CM veneer block generally indicated at 180*c*. The CM veneer block 180*c* includes many components the same as in CM veneer blocks 180, 180*a* and 180*b* of FIGS. 18, 21 and 22 respectively. Parts of the CM veneer block modification 180*c* of FIG. 22 which are the same as of CM veneer blocks 180 and 180*a* of FIGS. 18 and 21 and/or of CM veneer block 180*b* of FIG. 22 are identified with like numerals. The CM veneer block 180*c* of FIG. 23 includes three rearward projections 240 plus three rearward projections 242 having a configuration as shown (which is like that of the projections 240 and 242 with spacing 248 therebetween as in the embodiment of FIG. 22) plus three rearward projections 246 having a configuration as shown (which is like that of said projections 246 of FIG. 22). Notches or scores 244 are provided to mark where block 180*c* may be cut; and said notches are spaced distances c and d from block ends 187 and from the next adjacent notch 244 as shown in FIG. 23.

In this embodiment of FIG. 23, dimension c is 5 inches and dimension d is 3 inches, whereby the overall factory-made length f of CM block 180*c* is 24 inches. The CM veneer block 180*c* may be cut at one of the various notches 244 to yield a non-standard length of 5 inches, or 3 inches, or 11 inches, or 13 inches, or 16 inches, or 21 inches, as well as 24 inches original length.

Depending at which notch(es) 244 the CM veneer block 180*c* is cut, there will be provided one or two new end flanges 181 and 183 forming one or two new vertical end dovetail groove(s) 189 which extend vertically down part of the back of the thus cut CM veneer block 180*c*. Each such new end dovetail groove 189 is adapted to receive the block retainer means of a batten affixed to the substrate wall 72 as above discussed. The thus cut CM block 180*c* can be installed on two adjacent battens spaced less than modular length at a distance corresponding to any of the above-stated resultant cut CM block lengths, in a manner as above described with reference to the CM block embodiments 180*a* and 180*b* in FIGS. 21 and 22 plus FIGS. 17–18.

The CM veneer blocks of different configurations according to FIGS. 18, 21, 22 and 23 make is possible to use only three (or four) different standard length factory-made CM veneer blocks which can be cut in the field to a large number of different lengths probably satisfying the various non-modular spacings between battens likely to be encountered in the field. With the particular configurations and dimensional relationships of CM veneer blocks 180*a*, 180*b* and 180*c*, three such standard length CM veneer blocks made in the factory can be cut in the field to provide blocks of the following lengths: 4 inches, 8 inches, 3 inches, 5 inches, 12 inches, 11 inches, 13 inches, 16 inches, 19 inches, 20 inches, or 21 inches, as well as 24 inches.

Reference is now made to FIG. 30 which is a partly sectional and partly plan elevation view of two corners of a building incorporating concrete masonry veneer block cladding 170 installed on intersecting building exterior substrate walls 72 like CM veneer block wall cladding 170 disclosed in FIGS. 17–18 and 24 and described above. In FIG. 30 three building walls 72 intersect to form a representative "outside corner" generally indicated at 134 and a representative "inside corner" generally indicated at 136. Components of the wall, wall cladding and corner construction arrangement shown in FIG. 30 which are the same as components of the wall construction shown in FIGS. 17–18 plus 24, and the CM veneer blocks shown in FIGS. 17 and 21–23 are identified by like numerals and/or letters; and parts which are analogous to, or a variation of, parts of the wall and cladding construction and components shown in said Figures are identified by like numerals plus a different subscript letter. Each wall section 72 making up the corners 134 and 136 as shown in FIG. 30 is constructed in like manner as the wall section disclosed in FIGS. 17, 18 and 24. Each wall section includes building exterior substrate walls 72, insulation 220 and a plurality of battens 184 vertically secured to the outside of each building exterior wall 72 at suitable laterally spaced intervals in like manner as disclosed above with respect to FIGS. 17, 18 and 24 (whereby further details of the wall sections shown in FIG. 30 are not repeated here).

Reference is now particularly made to the outside corner CM veneer block generally indicated at 180*d* at the top of FIG. 30. Outside corner block 180*d* is of generally L-shape configuration in plan and includes a longer front facing side 186*a* which has an end face 187 plus a shorter facing side 186*b* which has an end face 187. Referring also to FIGS. 17–18 and 21 as well as FIG. 30, the CM veneer corner block 180*d* has a plan configuration as shown in FIG. 30 and includes a plurality of rearwardly extending projections 190 which have a plan configuration as shown and indicated at 240 and 242 in said Figure with spacing 250 therebetween. Projections 240 and 242 extend from one edge surface 91 of the block 180*d* for part of the overall height of the block in like manner as projections identified at 190, 240 and 242 with reference to the CM veneer block embodiments shown in FIGS. 18–21 and described above. Each pair of adjacent projections is separated by spacing 250 (see above discussion of FIG. 21 cf. FIG. 22). The longer front facing side portion 186*a* of outside corner block 180*d* has three of said projections 240 and three of said projections 242; and the shorter front facing side portion 186*d* has one projection 240 and one projection 242. The outside corner block 180*d* is provided with notches 244 at different lengths from each of ends 187 and between projections 240 and 242 as shown in FIG. 30 to indicate where to cut either both sides 186*a* and/or 186*b* of the block 180*d* in the field to provide one of a number of different lengths varying from the factory-made size of corner block legs 186*a* and 186*b*. In the configuration of outside corner block 180*d* shown in FIG. 30, the notches 244 are spaced from each end 187 and corner point 140 a distance b (same as length b in FIGS. 18 and 21 described above); and all other notches 244 in CM block 180*d* are spaced from each other a like distance b. As above noted, in a preferred U.S.A. commercial embodiment, said dimension b will be 4 inches. It is therefore possible to cut the CM veneer corner block 180*d* in FIG. 30 at any one of the notches indicated by numeral 244 in FIG. 30 so as to modify longer leg 186*a* of block 180*d* to a length of 4 inches, or 8 inches, or 12 inches, as well as original 16 inches, and to cut the shorter leg 186*b* of block 180*d* configuration to provide a length of 4 inches as well as original 8 inches.

Still referring particularly to the outside corner CM veneer block 180*d* shown in FIG. 30, rearwardly extending projection 240 adjacent the end 187 of the longer leg 186*a* has a pair of vertically extending flanges 181 and 183 which form an end dovetail groove 189. Similarly, the rearwardly extending projection 242 adjacent the end 187 of the shorter leg 186*b* of block 180*d* provides a pair of vertically extending flanges 181 and 183 which form a dovetail end groove 189. Each of said two end dovetail grooves 189 of corner block 180*d* receive the block retainer means 203 of batten 184 as illustrated in FIG. 30 with reference to FIGS. 24 and 17–18 so as to mount the corner block 180*d* on substrate wall 72 in a like manner as shown and described with reference to FIGS. 17, 18 and 24 above. When the longer leg 186*a* of corner block 180*d* is cut at any of notches 244 on that leg there will be provided a new end pair of vertically extending flanges like 181 and 183 which form a new end dovetail groove such as indicated at 189 in FIG. 30. This new end dovetail groove 189 is adapted to receive the block retainer means 203 of a batten 184 on that side of the thus cut CM block for mounting the altered corner block 180*d* between two battens 184 spaced apart a corresponding non-modular distance, in a manner apparent to those skilled in the art from the disclosure herein. In analogous manner, the shorter side 186*b* of corner block 180*d* may be cut at notch 244 shown in FIG. 30 and that will provide a new pair of vertically extending end flanges like 181 and 183 forming a new end dovetail groove 189. Accordingly, the thus cut block can be installed on the block retainer means 203 of a batten 184 so that block leg 186*b* thus cut can be mounted with battens spaced less than the original factory-made length of CM block leg 186*b*. Both legs 186*a* and 186*b* may be cut to provide a resultant corner block with two new length sides and two new end dovetail grooves 189, and the resultant corner block mounted on two battens 184 which are appropriately located on each of the intersecting walls forming corner 134. Also, with use of alternate battens such as shown in FIGS. 25–29 described above, the legs 186*a* and/or 186*b* of CM veneer corner block 180*d* may be similarly cut to different lengths and resultant end dovetail grooves 189 analogously mounted on such other type battens non-modularly spaced, in a manner apparent to those skilled in the art in light of the disclosure herein.

Figure 31:
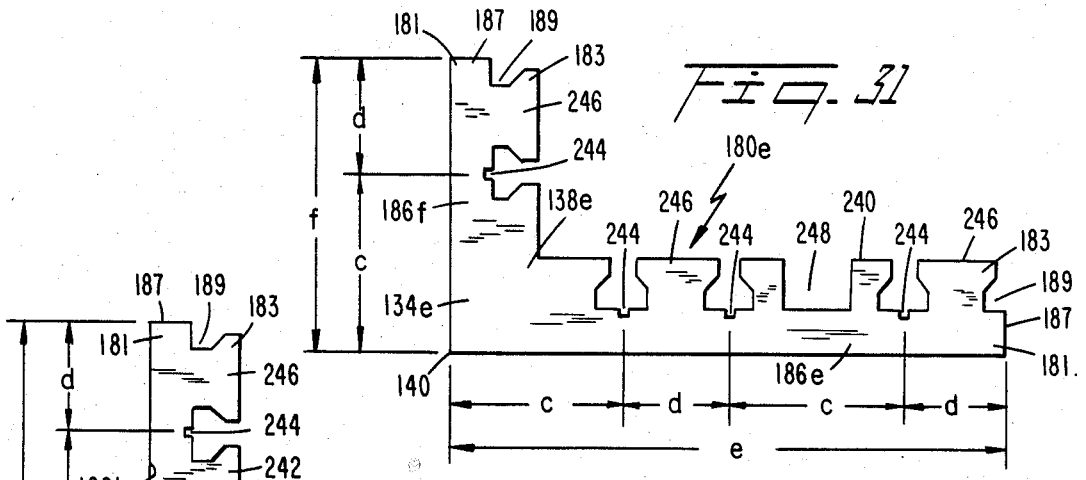
FIG. 31 is a plan view of an alternate configuration of concrete masonry veneer blocks for use on the outside corners of wall constructions according to FIGS. 17, 18 and 30; this alternate outside block configuration is usable in lieu of the outside block configuration shown in FIG. 30 and also can be similarly cut in the field to one of a number of different non-modular dimensions.
Figure 32:
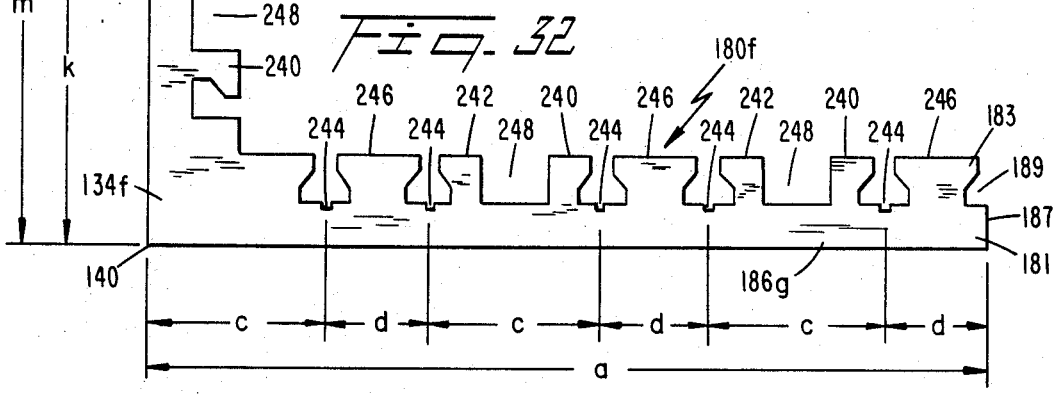
FIG. 32 is a plan view of still another configuration of concrete masonry veneer blocks for the outside corners of a wall construction according to FIGS. 17, 18 and 30, and this block configuration may also be similarly cut in the field to one of different non-modular lengths.

Reference is made to FIGS. 31 and 32 which show modifications of above-described outside corner CM veneer block 180*d* shown in FIG. 30, so as to provide alternate CM veneer corner block configurations and also make it possible to cut one or both sides or legs thereof to different lengths in the field. The outside corner CM veneer block of FIG. 31 is indicated generally at 180*e* and the outside CM veneer corner block of FIG. 32 is indicated generally at 180*f*. In FIGS. 31 and 32, portions of the CM veneer blocks 180*e* and 180*f* which are the same as in CM veneer block 180*d* shown in FIG. 30 (or the CM blocks of FIGS. 18–22) are identified with like numerals and/or letters; and portions of the respective CM veneer blocks 180*e* and 180*f* which are analogous to or a variation of portions of the CM veneer block 180*d* in FIG. 30 are identified by like numerals plus a different subscript letter.

Reference is now made particularly to FIG. 31 which shows an outside corner CM veneer block generally indicated at 180*e* which is like the corner veneer block 180*d* of FIG. 30 but has a different plan configuration as shown with differences noted below. The longer facing side or leg 186*c* has two rearwardly extending projections 246 of configuration as shown (which are like projections 246 in CM blocks 180*b* and 180*c* of FIGS. 22 and 23 above described) plus one rearward projection 240 and one rearward projection 242 with a space 248 therebetween (similar to corresponding sub-parts of said CM blocks 180*b* and 180*c* of FIGS. 22 and 23 above-described). The shorter corner block leg 186*f* has a rearwardly extending projection 246 near leg end 187. The corner portion 134*e* is configured as shown in FIG. 31. CM block 180*e* is provided with a plurality of notches 244 on the inside of each of legs 186*c* and 186*f* to indicate where the block may be cut to provide one of a different number of lengths varying from the factory-made length of said sides 186*e* and 186*f*. As shown in FIG. 31: the first notch 244 is spaced from end 187 of leg 186*e* a distance d; the second notch 244 is spaced from the first notch of side 186*e* a distance c; the third notch 244 is spaced from the second notch a distance d; and the next notch 244 is spaced a distance c from corner junction 140. On the shorter side 186*f*, the notch 244 is spaced from end 187 a distance d and is spaced from corner junction 140 a distance c. For U.S.A. use, the overall length a of longer side 186*e* of block 180*e* would be 16 inches, dimension d would be 3 inches, and dimension c would be 5 inches. The overall length f of shorter block side 186*f* would be 8 inches, dimension c is 5 inches, and dimension d is 3 inches. The CM veneer corner block modification 180*e* of FIG. 31 may be cut at one of notches 244 to provide a variety of different veneer block lengths for side 186*e* which may be 13 inches, or 8 inches, or 5 inches, as well as 16 inches original length. This will provide, where the notch 244 is cut, new end projections 181 and 183 forming a new end dovetail groove 189 which is adapted to receive the block retainer means of a batten correspondingly located on substrate wall 72. Similarly, the shorter side 186*f* of CM veneer corner block 180*e* may also be cut at the notch 244 to provide a new end dovetail retaining groove 189 for mounting the thus modified corner block 180*e* on the block retainer means of a batten correspondingly located on intersecting substrate wall 72. This cut provides a side length c of 5 inches as well as original length f of 8 inches. As apparent from FIG. 31 with reference to FIG. 30, the inside corner portion indicated at 138*e* provides end dovetail grooves 189 for mounting on battens, if sides 186*e* and/or 186*f* are cut at the notches closest to corner junction 140 in manner analogous to similarly cutting outside corner section 138 of block 180*d* of FIG. 30. The installation of the modified CM veneer corner block 180*e* of FIG. 31 on battens 184 analogous to corner block 180*d* as shown in FIG. 30 and described above will be apparent to those skilled in the art in light of the disclosure herein; so also will be the use of block 180e with alternate type battens such as shown in FIGS. 25–29 described above.

Reference is now made particularly to FIG. 32 which shows another embodiment of outside corner CM veneer block generally indicated at 180*f* which is like the above-described outside corner blocks 180*d* and 180*e* of FIGS. 30 and 31, subject to differences in detail now described. The longer side 186*g* of the corner block 180*f* of FIG. 32 includes two rearwardly extending projections 240 and two rearwardly extending projections 242 with spaces 248 between projections 240 and 242 (like projections 240 and 242 and spacing 248 of block 180*e* in FIG. 31) plus three rearwardly extending projections 246 (like projections 246 of CM veneer block 180*e* in FIG. 31) arranged as shown in FIG. 32. The shorter side 186*j* has one each of rearwardly extending projections 240 and 242 with spacing 248 therebetween plus one rearwardly extending projection 246 arranged as shown in FIG. 32. Longer leg 186*g* has at end 187 a pair of flanges 181 and 183 which form an end dovetail groove 189, and shorter leg 186*j* has like flanges 181 and 183 forming a like end dovetail groove 189. End dovetail grooves 189 are used to mount the CM corner block 180*f* n a pair of battens 184 having block retainer means received in such grooves 189 in like manner as the corner block 180*d* shown in FIG. 30 and described above. The longer side 186*g* of corner block 180f may be cut at any one of the notches indicated by numeral 244 in FIG. 32 to provide a new end dovetail groove 189 located a distance from corner 140 depending on which notch 244 is cut. Similarly, the shorter side 186*j* may be cut at the notch 244 in FIG. 32 to provide a shorter side having a new end dovetail groove 189. The CM veneer corner block 180*f* thus cut on sides 186*g* and/or 186*j* is then mounted by securing the resultant end dovetail groove(s) 189 on block securing means 203 of adjacent battens 184 which are appropriately located on substrate walls 72. The notches 244 on longer side 186*g* of block 180*f* are spaced from corner point 140 and from each other distances c, d, c, d, c and d as shown in FIG. 32. Length c is 5 inches, length d is 3 inches, and length cd is 8 inches. Thus, the side 186*g* can be cut to a length of 5 inches, or 8 inches, or 13 inches, or 16 inches, or 21 inches, besides original length a of 24 inches. The notch 244 on shorter side 186*j* in FIG. 32 is located distance d from end 187 which is 3 inches and distance k from corner junction 140 which is 9 inches. Thus shorter side 186*f* can be cut to a length of 9 inches, besides original length m of 12 inches. Again, it will be apparent to those skilled in the art that alternative type battens such as shown in FIGS. 25–29 can be used in lieu of the batten of FIG. 24 for mounting corner block 180*f* with either or both sides 186*g* and 186*j* uncut or cut.

Reference is now made again particularly to FIG. 30 to more specifically describe a suitable embodiment of inside corner CM veneer block generally indicated at 180*g* and installed at an inside corner which is formed by intersecting substrate walls 72 and is generally indicated at 136 in the lower portion of FIG. 30. Inside corner block 180*g* is generally L-shaped in plan and includes a longer side and facing section 186*c* which has an end face 187 and a shorter side and facing section 186*d* which has an end face 187. The longer facing side 186*c* of inside corner block 180*g* has three rearwardly extending projections 240 and three rearwardly extending projections 242 with spacings 250 therebetween (like projections 240 and 242 and spacing 250 in the block 180*d* of FIG. 30 and of blocks 180 and 180*a* of FIGS. 18 and 21 described above). The end projection 240 on longer block side 186*c* forms one end dovetail groove 189, and the end projection 242 on shorter block side 186*d* forms a second end dovetail groove 189. The inside CM veneer corner block 180*g* is mounted on intersecting substrate walls 72 as shown in FIG. 30 by means of said two end dovetail grooves 189 receiving block retaining portions 203 of battens 184 vertically secured to building exterior substrate wall 72 as shown (in manner like that described above with reference to FIGS. 17, 18 and 24 plus FIG. 30). The shorter side 186*d* of block embodiment 180*g* has no notches 244 for cutting. The longer side 186*c* of CM veneer corner block 180*g* may be cut at either of the two notches indicated at 244 in FIG. 30, thereby providing a new end dovetail groove 189 with different side length depending on which notch 244 is cut. Inside corner block 180*g* with thus cut side 186*c* can be installed on battens 184 appropriately spaced in a manner analogous to similarly cut outside corner blocks 180*d*, 180*e* and 180*f* as discussed above with reference to FIGS. 30–32 plus FIGS. 17, 18 and 24. Other type battens above-described may be used as will be apparent from the disclosure herein.

Figure 34:
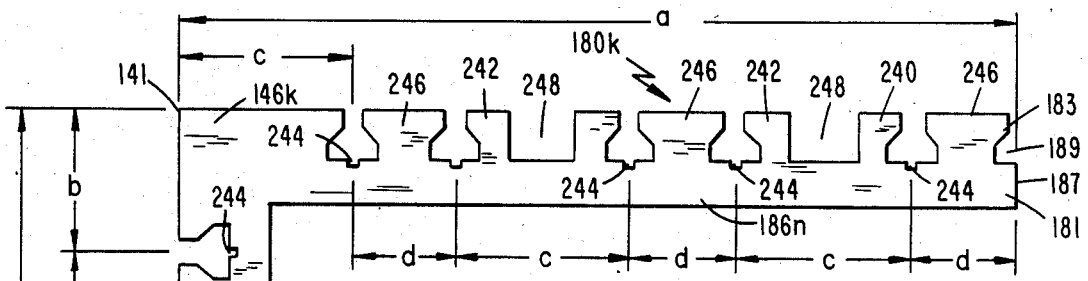
FIG. 34 is a plan view of still another configuration of concrete masonry veneer blocks for use in the inside corners of a wall construction according to FIGS. 17, 18 and 30; and this alternate block configuration may also be cut in the field to one of a number of different non-modular dimensions.
Figure 33:
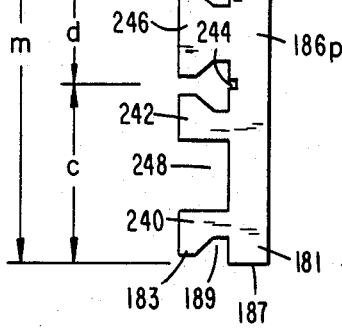
FIG. 33 is a plan view of an alternate configuration of such concrete masonry veneer blocks for use on the inside corners of a wall construction according to FIGS. 17, 18 and 30; this alternate inside block configuration is usable in lieu of the inside block configuration shown in FIG. 30 and also can be similarly cut in the field to one of a number of different non-modular dimensions.
Figure 33:
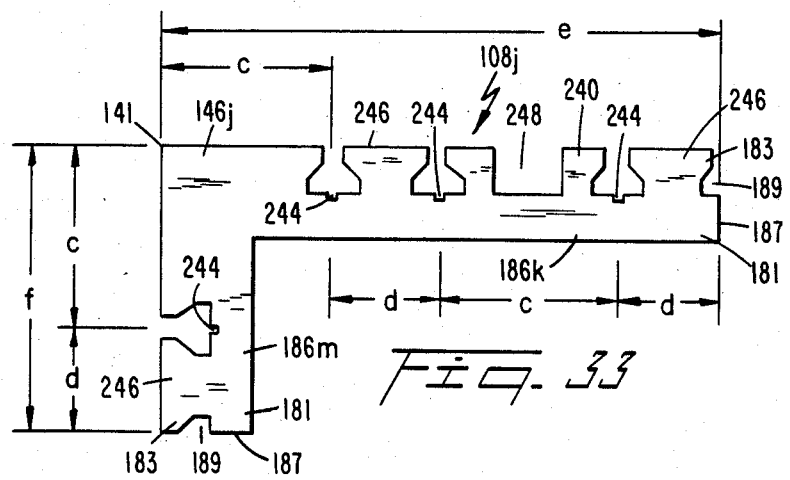

Reference is now made to FIGS. 33 and 34 which show modifications of the above-described inside corner CM veneer block 180g shown in FIG. 30. FIGS. 33 and 34 respectively show alternative inside corner CM veneer block configurations 180*j* and 180*k* which may be cut to additional different lengths of sides in the field. Portions of block 180*j* of FIG. 33 and of block 180*k* of FIG. 34 which are the same as parts of inside corner CM veneer block 180*g* in FIG. 30 are identified with like numerals and/or letters, and portions of the CM veneer blocks 180*j* and 180*k* of FIGS. 33 and 34 which are analogous to, or a variation of, portions of block 180*g* in FIG. 30 are identified by like numerals plus a different subscript letter.

Reference is now made particularly to FIG. 33 which shows an inside corner CM veneer block generally indicated at 180*j* which is like the inside corner veneer block 180*g* of FIG. 30 but has a different plan configuration as shown with differences noted below. The longer side or leg 186*k* of block 180*g* has two rearwardly extending projections 246 of configuration as shown (which are like projections 246 in the above-desribed CM blocks of FIGS. 31, 32, 21 and 22) plus one rearward projection 240 and one rearward projection 242 with a spacing 248 therebetween (similar to projections 240 and 242 with spacing 248 on the longer side 186*e* of outside corner CM block 180*e* of FIG. 31 above-described). The shorter side 186*m* of corner block 180*g* has one rearwardly extending projection 246 near leg end 187. CM block 180*j* is provided with notches 244 on the inside of legs 186*k* and 186*m* to indicate where the block may be cut in the field to provide one of a different number of lengths varying from the factory-made length of said sides 186*k* and 186*m*. As shown in FIG. 33, the first notch 244 of longer side 186*k* is spaced from end 187 a distance d; the second notch 244 is spaced from the first notch of side 186*k* a distance c; the third notch 244 is spaced from the second notch a distance d and is spaced a distance c from corner junction 141. On the shorter side 186*m*, the notch 244 is spaced from end 187 a distance d and is spaced from corner junction 141 a distance c. For U.S.A. use, dimension c would be 5 inches, dimension d would be 3 inches, and dimension cd would be 8 inches. The CM veneer block 180*j* of FIG. 33 may be cut at one of notches 244 on longer side 186*k* to provide a variety of different side lengths which may be 5 inches, or 8 inches, or 13 inches, besides 16 inches original length e. Where the notch 244 is cut there will be formed a new end dovetail groove 189 which is adapted to receive the block retainer means 203 of a batten 184 so as to mount the cut block 180*j* on a pair of appropriately spaced battens. Similarly, the shorter side 186*m* of CM veneer corner block 180*j* may also be cut at the notch 244 to a length c of 5 inches, besides original length of 8 inches. The block thus cut has a new end dovetail retaining groove 189 for mounting the cut corner block 180*j* on the block retainer means of a batten appropriately located from the block corner 141. The installation of the modified inside corner CM veneer block 180*j* of FIG. 33 (cut or uncut) on battens 184 analogous to inside corner block 180*g* as shown in FIG. 30 and described above as will be apparent to those skilled in the art in light of the disclosure herein; so also will be the use of CM block 180*j* with alternate battens such as shown in FIGS. 25–29 described above.

Reference is now made particularly to FIG. 34 which shows another embodiment of outside corner CM veneer block generally indicated at 180*k* which is like the above-described inside corner blocks 180*g* and 180*j* of FIGS. 30 and 33, subject to differences in detail now described. The longer side 186*n* of inside corner block 180*k* of FIG. 34 includes two sets of rearwardly extending projections 240 and 242 with spacings 248 therebetween (like projections 240 and 242 with spacings 248 of the CM blocks shown in FIGS. 31–33 and FIGS. 22–23) plus three rearwardly extending projections 246 (which are like projections 246 of the CM veneer blocks shown in FIGS. 31–33 and FIGS. 22–23) arranged as shown in FIG. 34. The shorter side 186*p* of block 180*k* has one each of rearwardly extending projections 240 and 242 with spacing 248 therebetween plus one rearwardly extending projection 246 arranged as shown in FIG. 34. Longer side 186*n* has adjacent end 187 a pair of flanges 181 and 183 which form an end dovetail groove 189; and shorter leg 186*p* has like flanges 181 and 183 forming a like end dovetail groove 189. End dovetail grooves 189 are used to mount the CM corner block 180*k* on a pair of battens 184 having block retainer means received in such grooves 189 in like manner as the inside corner block 180*g* shown in FIG. 30 and described above. The longer side 186*n* of corner block 180*k* may be cut at any one of notches 244 in FIG. 34 to provide a new end dovetail groove 189 which is located a distance from corner junction 141 depending on which notch 244 is cut. Similarly, the shorter side 186*p* may be cut at either of the two notches 244 shown in FIG. 34 to provide a new end dovetail groove 189 on that side of the corner block 180*k*. The notches 244 on longer side 186*n* are spaced from ends 187 and from corner point 140 and from each other distances c and d shown in FIG. 34. Length c is 5 inches, length d is 3 inches, and length cd is 8 inches. Thus, the longer side 186*n* can be cut to a length of 5 inches, or 8 inches, or 13 inches, or 16 inches, or 21 inches, besides original length a of 24 inches. One notch 244 on shorter side 186*p* shown in FIG. 34 is located distance c from end 187 which is 5 inches, and the second notch 244 is at a distance d from said first notch which is 3 inches and a distance b from corner junction 141 which is 4 inches. Thus shorter side 186*p* can be cut to lengths of 4 inches and 7 inches, besides original length m of 12 inches. The CM veneer corner block 180*k* thus cut on sides 186*n* and/or 186*p* is then mounted by securing the resultant end dovetail groove(s) 189 on block securing means 203 of two adjacent battens 184 which are appropriately located. Again, it will be apparent to those skilled in the art that alternative battens such as shown and described can be used in lieu of batten 184 of FIG. 24 for mounting inside corner block 180*k* with either or both sides 186*n* and 186*p* uncut or cut.

Referring to FIGS. 30–34, it is noted that the respective CM corner blocks shown in these drawings may be cut at various notches 244 not to make short leg sections for use as different size outside or inside corner blocks but to make straight CM block portions of varying length according to the spacing of the notches cut; such straight block portions are usable similar to short sections made from CM veneer blocks 180, 180*a* and 180*b* shown in FIGS. 18, 20 and 21 as above discussed.

The CM veneer blocks shown in FIGS. 17–20 and 30–34 can readily be provided with various types of decorative surfaces (not shown) using existing equipment and existing type concrete masonry mixes. Such CM veneer blocks lend themselves to making a new improved veneer block wall cladding which provides a good functional finish and other advantages, and they can be used to upgrade simple concrete block exterior wall constructions or other types of conventional wall constructions.

The inventions may be embodied in other specific forms without departing from the spirit or essential characteristics thereof. The present embodiments are, therefore, to be considered in all respects as illustrative and not restrictive, the scope of the inventions being indicated by the appended claims and all changes which come within the meaning and range of equivalency of the claims are, therefore, intended to be embraced therein.

What is claimed is:

1. A concrete masonry block veneer wall cladding construction for a building comprising a substrate exterior wall;

support means anchored to said substrate wall and extending generally horizontally along said wall;

a plurality of elongated battens secured to said substrate wall at laterally spaced intervals and extending generally above said horizontally extending support means;

a column of concrete masonry veneer blocks vertically supported by said horizontally extending support means with portions of said CM blocks secured to adjacent laterally spaced battens so that CM blocks are mounted on said substrate wall, said column of blocks being defined by plural courses of blocks stacked on said support means.

2. A concrete masonry block veneer wall cladding construction according to claim 1 wherein:

said concrete masonry veneer blocks each have a generally rectangular configuration in front elevation with end sides thereof having end grooves extending therein; and said battens include block retainer means extending along the length thereof which are received in said CM block end grooves for mounting of said CM blocks on said battens on said substrate wall.

3. A concrete masonry block veneer wall cladding construction according to claim 1 wherein:

each of said battens has an elongated generally L-shaped base portion with a first leg thereof secured to said substrate wall by fastener means and a second leg extending outwardly from said first leg and substrate wall, and block retainer means connected to said second leg of said L-shaped base portion; and each of said CM blocks has means for receiving said block retainer means of said battens so that the CM blocks are thus attached to the battens and to said substrate wall.

4. A concrete masonry block veneer wall cladding construction according to claim 3 wherein:

said concrete masonry blocks each have a generally rectangular configuration in front elevation with grooves extending therein; and said battens include block retainer means extending along the length thereof which are received in said CM block grooves for mounting of said CM blocks on said battens on said substrate wall.

5. A concrete masonry block veneer wall claddig as defined in claim 4 wherein: said CM blocks each have end grooves extending along end sides thereof, said end grooves receiving said block retainer means of said battens along the end sides of said CM blocks.

6. A concrete masonry block veneer wall cladding as defined in claim 4 wherein: said CM blocks each have grooves in mid-portions thereof between the end sides of said CM blocks, said grooves receiving said block retainer means of said battens.

7. A concrete masonry block veneer wall cladding according to claim 4, wherein said block retainer means is integrally connected to said L-shaped base portion of said battens.

8. A concrete masonry block veneer wall cladding according to claim 6, wherein said block retainer means are disposed within said grooves extending in mid-portions of said CM blocks, and said block retainer means are interlocked with said second leg of the L-shaped base portion of said battens.

9. A concrete masonry block veneer wall cladding construction according to claim 2 wherein:

each of said battens has an elongated generally L-shaped base portion with a first leg thereof secured to said substrate wall by fastener means and a second leg extending outwardly from said first leg and substrate wall, and block retainer means connected to said second leg of said L-shaped base portion and received in said end grooves of said CM blocks so that the CM blocks are thus attached to the battens and to said substrate wall.

10. A concrete masonry veneer block wall cladding according to any one of claims 2 to 5, 7 or 9, wherein said battens including said block retainer means are made of metal.

11. A concrete masonry veneer block wall cladding according to any one of claims 2, 4, 5, 6, 8 or 9, wherein said battens including said block retainer means are made of plastic.

12. A concrete masonry block veneer wall cladding construction according to any of claims 2 to 9 further comprising insulation secured to said substrate wall between the outside surface of said substrate wall and the inside of the wall cladding formed by said concrete masonry veneer blocks mounted on said substrate wall.

13. A concrete masonry block veneer wall cladding construction according to any of claims 2 to 9 wherein:

said battens and said CM veneer blocks are configured, dimensioned and mounted so that when the CM veneer blocks are mounted on said battens an air space is provided between the inside of the concrete masonry veneer block wall cladding and said substrate wall.

14. A concrete masonry block veneer wall cladding construction according to claim 1 wherein said battens and said CM veneer blocks are configured, dimensioned and mounted so that when the CM veneer blocks are mounted on said battens an air space is provided between the inside of the concrete masonry veneer block wall cladding and said insulation on said substrate wall.

15. A concrete masonry veneer block wall cladding construction according to any of claims 2–9 wherein: each of said concrete masonry veneer blocks has a face portion of generally rectangular configuration, and the CM block has a plurality of projections extending rearwardly from said CM block face portion; said rearwardly extending projections being configured so that when the CM block is cut adjacent to one of said projections the resultant new rearwardly extending end projection forms a new end side groove for connecting the thus cut CM veneer block to a pair of adjacent battens which are laterally spaced from each other a distance less than the length of the uncut CM block and corresponding to the length of the thus cut CM block.

16. A concrete masonry veneer block wall cladding construction according to claim 15 wherein each said CM block includes a plurality of markings in conjunction with said rearwardly extending projections to indicate where the CM block is to be cut to provide one of a number of different lengths for mounting the cut CM block between a pair of adjacent battens spaced apart a distance corresponding to the length of a thus cut CM block.

17. A concrete masonry veneer block wall cladding construction according to any of claims 2 to 9 comprising first and second intersecting substrate walls forming a corner and having concrete masonry veneer block wall cladding mounted on spaced battens on each of said substrate walls as set forth in any of said claims 2 to 9, and further comprising:

concrete masonry veneer corner blocks each substantially L-shaped in plan view and having two side face portions, said concrete masonry corner blocks being mounted on horizontal support means and on vertically extending battens secured to said first and second substrate walls, in like manner as said CM blocks as set forth in any of claims 2 to 9.

18. A concrete masonry veneer block wall cladding construction as set forth in claim 17 wherein: said substrate walls intersect forming an outside corner; and each of said concrete masonry veneer outside corner blocks includes means for mounting said CM blocks on said battens secured to said first and second substrate walls.

19. A concrete masonry veneer block wall cladding construction as set forth in claim 17 wherein: said substrate walls intersect forming an inside corner; and each of said concrete masonry veneer inside corner blocks includes means for mounting said CM blocks on said battens secured to said first and second substrate walls.

20. A concrete masonry veneer block wall cladding construction according to claim 17 wherein: each of said two sides of the corner CM veneer blocks has a face portion of generally rectangular configuration, and a plurality of projections extend rearwardly from said face portion of each of said two block sides; said rearwardly extending projections being configured so that when the CM block is cut adjacent to one of said projections the resultant new rearwardly extending end projection forms a new end side groove for connecting the thus cut CM veneer block to a pair of battens which are mounted on said first and second interconnecting substrate walls spaced from the corner thereof a distance less than the length of the uncut block sides and corresponding to the length of the thus cut block side.

21. A concrete masonry veneer block wall cladding construction according to claim 20 wherein: each said corner CM block includes a plurality of markings in conjunction with said rearwardly extending projections to indicate where each side of said CM block is to be cut to proviode one of a number of different CM corner block side lengths.

22. A concrete masonry block veneer wall cladding construction according to claim 2 wherein: each of said battens has a generally U-shaped channel cross section with the base part thereof secured to said substrate wall by fastener means; and each of the pair of sides extending from said base part has a flange extending longitudinally therealong and projecting laterally outward from said sides, each such flange being received in one of said block end grooves whereby the blocks are thus attached to the battens and to said substrate wall.

23. A concrete masonry block veneer wall cladding construction according to claim 2 wherein:

each of said battens has a generally U-shaped metal channel cross section with the base part thereof secured to said substrate wall by fastener means and a pair of sides extending from said base part with each of said sides having a clip member extending longitudinally therealong and projecting laterally outwardly from said sides; and an insert is mounted in said block end grooves, each said insert having a recess which receives one of said laterally projecting clips for securement of a block end groove whereby the blocks are mounted on the battens and on said substrate wall.

24. A concrete masonry block veneer wall cladding construction according to claim 2 wherein:

each of said battens has a generally U-shaped channel cross section with the base part thereof secured to said substrate wall by fastener means and the pair of sides extending from said base part with each of said sides having adjacent the end thereof ratchet teeth extending longitudinally along the length of said sides and projecting laterally outwardly therefrom; and an insert is mounted in each of said CM block end grooves, each said insert having a recess with ratchet teeth on one side thereof said recess receiving the end of said batten channel sides with the ratchet teeth of said sides engaging and locking with the ratchet teeth in said inserts to secure said blocks to the battens and thereby mount them on said wall.

25. A concrete masonry block veneer wall cladding construction according to claim 2 wherein each of said battens includes an elongated piece of lumber of generally rectangular cross section secured to said wall by fastener means and a plurality of spaced members extending along two sides of said elongated wooden member and providing laterally projecting flanges which extend longitudinally along said wooden member at spaced intervals, said latterally extending flanges being received in said block end grooves so as to secure said blocks to said battens and thereby mount the blocks on said wall.

26. A concrete masonry block veneer wall cladding construction for a building comprising:

a substrate exterior wall;

a plurality of support means anchored to said substrate wall at vertically spaced intervals and extending generally horizontally along said wall;

a plurality of elongated battens secured to said substrate wall at laterally spaced intervals and extending generally verfically above each of said generally horizontally extending support means;

a column of concrete masonry veneer blocks vertically supported by each of said horizontally extending support means with portions of said CM blocks secured to adjacent laterally spaced battens so that said CM blocks are mounted on said substrate wall, said column of blocks being defined by plural courses of blocks stacked on a given one of said support means.

27. A multi-story concrete masonry block veneer wall cladding construction for a multi-story building according to claim 26 wherein:

each of said battens has an elongated generally L-shaped base portion with a first leg thereof secured to said substrate wall by fastener means and a second leg extending outwardly from said first leg and substrate wall, and block retainer means connected to said second leg of said L-shaped base portion; and each of said CM blocks has means for receiving said block retainer means of said battens so that the CM blocks are thereby attached to the battens and to said substrate wall.

28. A multi-story concrete masonry block veneer wall cladding construction for a multi-story building according to claim 27 wherein:

said concrete masonry blocks each have a generally rectangular configuration in front elevation with end grooves extending along end sides thereof, and said block end grooves receive said block retainer means of said battens along the end sides of said CM blocks.

29. A multi-story concrete masonry block veneer wall cladding for a multi-story building according to claim 27; wherein said block retainer means is integrally connected to said L-shaped base portion of said battens.

30. A multi-story concrete masonry veneer block wall cladding according to claim 27 wherein said battens and block retainer means are made of metal.

31. A multi-story concrete masonry block veneer wall cladding construction for a multi-story building according to any of claims 27 to 30 further comprising insulation secured to said substrate wall between said horizontally extending support means and between the outside surface of said substrate wall and the inside of the wall cladding formed by said concrete masonry veneer blocks mounted on said substrate wall.

32. The concrete masonry veneer wall cladding construction of claim 26, wherein said substrate wall is a multi-story substrate wall.

* * * * *